United States Patent [19]

Takada et al.

[11] Patent Number: 4,952,490

[45] Date of Patent: Aug. 28, 1990

[54] PHOTOGRAPHIC LIGHT-SENSITIVE MATERIAL AND METHOD OF DEVELOPING THE SAME

[75] Inventors: Shunji Takada; Toshihiro Nishikawa; Kei Sakanoue; Akira Abe, all of Minami-ashigara, Japan

[73] Assignee: Fuji Photo Film Co., Ltd., Minami-ashigara, Japan

[21] Appl. No.: 162,554

[22] Filed: Mar. 1, 1988

[30] Foreign Application Priority Data

Mar. 2, 1987 [JP] Japan ..... 62-47225

[51] Int. Cl.[5] ..... G03C 1/06

[52] U.S. Cl. ..... 430/567; 430/376; 430/569; 430/603; 430/605

[58] Field of Search ..... 430/567, 603, 605, 569, 430/376

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,435,501 | 3/1984 | Maskasky | 430/434 |
| 4,439,520 | 3/1984 | Kofron et al. | 430/434 |
| 4,478,929 | 10/1984 | Jones et al. | 430/217 |
| 4,622,287 | 11/1986 | Umemento et al. | 430/505 |

*Primary Examiner*—Paul R. Michl
*Assistant Examiner*—Janet C. Baxter
*Attorney, Agent, or Firm*—Burns, Doane, Swecker & Mathis

[57] ABSTRACT

A photographic light-sensitive material comprises a support having thereon at least one silver halide emulsion layer. At least 70% of a total number of silver halide grains contained in the emulsion layer are regular crystal grains not having a twinning plane. At least 50 mol% of the regular grains are silver chloride. The regular crystal grains have a (111) crystal plane on 30% or more of a total grain surface and are chemically sensitized in the presence of a gold compound or sulfur and gold compounds.

24 Claims, 3 Drawing Sheets

PHOTOGRAPHIC LIGHT-SENSITIVE MATERIAL AND METHOD OF DEVELOPING THE SAME

BACKGROUND OF THE INVENTION

1. Field of the Invention

The present invention relates to a photographic light-sensitive material having a novel silver halide emulsion and a method of developing the same. 2. Description of the Related Art Considerable effort has been expended to suppress fogging of a silver halide emulsion and to increase its photographic sensitivity. In addition, a reduction in the time required to carry out all the developing steps such as development, bleaching, and fixing is a practical great merit and is one of important targets in performance improvement of silver salt photography. Minimization of changes in photographic characteristics caused by variations in processing conditions also provides a great merit. Conventionally, a silver iodobromide emulsion subjected to gold-plus-sulfur sensitization is practically used as a high-speed photographing material. However, when a silver iodobromide emulsion is used, a developing time cannot be reduced because development is significantly restrained by iodide ions or bromide ions, released during development. In addition, since these ions are stored in a processing liquid, variations in photographic characteristics are increased. Also, these ions adversely affect a bleaching step. Furthermore, since the silver iodobromide emulsion has low solubility in water, a long period of time is required for fixing. On the contrary, when a silver chloride emulsion having a high silver chloride content and containing substantially no silver iodide is used, the time required for development, bleaching, and fixing steps can be reduced, and changes in photographic characteristics caused by variations in the processing conditions can be minimized. In a high silver chloride emulsion, cubic grains having a (100) crystal plane are normally formed. When these grains are chemically sensitized, they tend to be fogged. This fog is significant especially when the grains are subjected to gold sensitization. More specifically, fogging poses a problem in practical use in a developer having high activity for rapid development, especially, in a color developer. Storage fog generated when a light-sensitive material is aged also poses a practical problem. When a high silver chloride emulsion is exposed at high intensity for a short period of time, reciprocity failure is increased. This is another drawback of the high silver chloride emulsion when it is used as a high-speed photographing material. Although it is known that a regular crystal high silver chloride emulsion having a (111) crystal plane can be prepared by a special method, not so many studies have been made so far. In addition, almost no high silver chloride emulsion for use in a high-speed photographing material is known. The Journal of Photographic Science, Vol. 21, P. 39 (1973) only reports that silver halide grains having the (111) crystal plane can be prepared using dimethylthiourea, but does not refer to its photographic characteristics. In the International Congress of Photographic Science (Rochester 1978), Wyrsch reports that grains having the (111) crystal plane can be prepared using a cadmium compound and ammonia. He reports that no large difference in photographic sensitivity is found between grains having the (111) crystal plane and those having the (100) crystal plane when they are compared using a sulfur-sensitized emulsion but the grains having the (100) crystal plane have slightly higher sensitivity Japanese patent application (OPI) No. 55-26,589 discloses that silver halide grains having the (111) crystal plane can be obtained by supplying a merocyanine dye during grain formation. However, this patent specification discloses not high silver chloride grains for use in a high-speed photographing material but effectiveness of limiting a dye addition method regardless of a crystal plane or a grain composition. In this manner, it is well known that a high silver chloride emulsion is a preferable material for reducing a time required for processing steps. However, it is considered that manufacture of a high-speed photographing material of high silver chloride is technically difficult because fog is significantly increased and the high-intensity reciprocity failure is large when the high silver chloride emulsion is chemically sensitized to achieve high sensitivity. In addition, it is also well known that fog is increased when gold sensisization is performed. That is, a technique for sufficiently performing gold-plus-sulfur sensitization, which is an essential treatment for a high-speed photographing material, to the high silver chloride emulsion has not been realized. Therefore, almost no examples of a high-speed photographing material using the high silver chloride emulsion are known.

SUMMARY OF THE INVENTION

It is, therefore, a first object of the present invention to provide a silver halide photographic light-sensitive material having low fog and high photographic sensitivity and which can be rapidly developed.

It is a second object of the present invention to provide a silver halide photographic light-sensitive material for high-speed photographing having a small reciprocity failure and storage fog.

It is a third object of the present invention to provide a photographing light-sensitive material of a constant quality even when desilverizing including color development, bleaching, and fixing is rapidly performed and continuous development is performed.

It is still another object of the present invention to provide a method of developing a silver halide light-sensitive material in which fog is low and a constant quality can be obtained.

It is still another object of the present invention to provide a developing method wherein the time required for a developing step can be reduced to less than two minutes and which can be used for various purposes.

Other objects of the present invention will be apparent from the following description.

The above objects of the present invention can be achieved by a photographic light-sensitive material comprising a support having thereon at least one silver halide emulsion layer, wherein at least 70% of a total number of silver halide grains contained in the silver halide emulsion layer are regular crystal grains not having a twinning plane, at least 50 mol % of the regular crystal grains are silver chloride, and the regular crystal grains have a (111) crystal plane on at least 30% of their total grain surface and are chemically sensitized in the presence of a gold compound or sulfur and gold compounds.

The other objects of the present invention can be achieved by a method of developing, wherein the above desired photographic light-sensitive material is color developed in the presence of color couplers.

The present invention will be described in the following order:

(1) Silver Halide Emulsion Layer Containing Regular Crystal Grains 1-1 Regular Crystal Grains
1-2 Halide Composition, Inner Structure
1-3 (111) Crystal Plane
1-4 Grain Formation
1-5 Chemical Sensitization
1-6 Spectral Sensitization
1-7 Additives (e.g., Mercapto Group-containing Compound)

(2) Color Image Forming Compound 2-1 Color Couplers (Yellow, Magenta, and Cyan)
2-2 Functional Couplers
2-3 Additives
2-4 Dispersion Method
2-5 ISO Sensitivity (3) Developing Method 3-1 Color Developers
3-2 N-hydroxyalkyl Substituted-p-phenylenediamine Derivatives
3-3 Color Developer Additives
3-4 Desilvering Step
3-5 Washing/Stabilization
3-6 Developing Method (4) EXAMPLES (1) Silver Halide Emulsion Layer Containing Regular Crystal Grains In a silver halide emulsion layer of this invention, at least 70% of a total number of silver halide grains are regular crystal grains not having a twinning plane, at least 50% of the regular crystal grains are a chloride, and the regular crystal grains have (111) crystal planes on 30% or more of a total grain surface, are chemically sensitized in the presence of a gold compound or gold and sulfur compounds, and are spectrally sensitized as needed.

1-1. Regular Crystal Grains

Regular crystal grains not having a twinning plane according to the present invention are well known to those skilled in the art. The twinning plane is described in T. H. James, The Theory of the Photographic L, Process, 4th. ed., Macmillan (1977) (to be referred to as "James' Book" hereinafter), FIG. 1–9 on page 22 and the section on Shape of C Crystal on page 98. As described in the right column of page 98, silver chloride is essentially ionic, and therefore the (111) crystal plane is normally not found. However, the present invention relates to an emulsion layer containing silver halide grains having a Miller indices (111) crystal plane on an outer surface although it has a high silver chloride content.

1-2. Halide Composition, Inner Structure

The regular crystal grains of this invention are silver halide grains substantially not containing silver iodide. In this case, an expression "substantially not containing silver iodide" means that a molar content of silver iodide is 2 mol % or less, preferably, 1 mol % or less, and more preferably, 0.1 mol % or less.

At least 50% of the regular crystal grains of this invention are silver chloride A silver chloride content, i.e., a molar content of silver chloride is preferably 75 mol % or more, more preferably, 90 mol % or more, and most preferably, 95 mol % or more.

The remaining halide components of the regular crystal grains of this invention are silver bromide and silver iodide (whose content is defined above), and silver bromide is preferred.

The regular crystal grains of this invention may have a uniform inner crystal structure, a structure in which a halide composition of an inner portion differs from that of an outer portion, or a layer structure of three or more layers. In addition, silver halides having different compositions may be bonded by an epitaxial junction.

In the regular crystal grains of this invention, it is preferred that a layer containing a large amount of silver bromide is locally present on the surface or a portion near the surface of the grains. In the case of core/shell type grains, a silver halide content of a core portion is preferably higher than that of a shell portion. The layer having a large amount of silver bromide present on the surface or a portion near the surface of the grains may be formed by a so-called conversion method, i.e., by conversion of bromide ions into silver chloride.

Any grains other than the regular crystal grains of this invention may exist together with the grains of this invention in an amount corresponding to less than 30% of the total grain number The grains may be those having a twinning plane or regular crystal grains in which a definition of a halide composition or an outer surface of a crystal does not correspond to that described above.

The regular crystal grains of this invention must exist in a silver halide emulsion layer in an amount corresponding to at least about 70% of the total grain number. More specifically, the number of the regular crystal grains is preferably 80% or more, and more preferably, 90% or more.

A halide composition of each silver halide grain can be measured using an electron beam microanalyzer. This EPMA method is described in, e.g., Japanese patent application (OPI) No. 60-143,332.

1-3. (111) Crystal Plane

The regular crystal grains of this invention have an outer surface consisting of a (111) crystal plane and where at least 30%, preferably, 50% or more, more preferably, 75% or more, and most preferably, 90% or more of the total outer surface area consists of the (111) crystal plane. The (111) crystal plane can be quantified on the basis of an electron microscopic photograph of formed silver halide grains by a method known to those skilled in the art. Typical grain shapes included in the present invention are an octahedron, a tetradecahedron, and the like.

Although an average grain size of the silver halide grains of this invention is not limited, it is preferably 0.1μ to 5μ, and more preferably, 0.2μ to 3μ. A grain size distribution of the silver halide grains of this invention may be either multi-dispersion or monodispersion, but mono-dispersion is preferable.

The silver halide emulsion of this invention may be either an inner sensitive emulsion or a surface sensitive emulsion. The silver halide emulsion of this invention is a negative type.

1-4. Grain Formation

The regular crystal grains of this invention can be formed by a conventional method, or preferably, a method found by the present inventors.

In general, as silver halide grains having a high silver chloride content (to be referred to as "high silver chloride grains" hereinafter), only cubic grains consisting of the (100) crystal plane can be obtained. However, octahedral grains consisting of the (111) crystal plane can be obtained by some improvements as described in, e.g., Claes et al.; The Journal Photographic Science, Vol. 21, 39 (1973) and Wyrsch; International Congress of Photographic Science, III-13, 122 (1978).

In the former reference, a compound, e.g., adenine, dimethylthiourea, or thiourea is used. Considering a structure of a compound, a compound such as adenine has a relatively high adsorption tendency for a silver halide or tends to generate fog due to unstable sulfur molecules.

In the latter reference, octahedral grains are obtained using ammonia and a large amount of cadmium nitrate. However, cadmium poses a practical problem of environmental pollution.

Since high silver chloride grains tend to generate fog, use of ammonia is not preferable That is, it is preferable that the high silver chloride octahedral grains can be prepared without ammonia.

Japanese patent application (OPI) No. 55-26,589 discloses a method of preparing octahedral grains using a merocyanine dye. In this method, since dye adsorption is strong, preferable photographic characteristics can be obtained. However, only a specific dye structure can form an octahedron. Therefore, in preparation of blue-, green-, and red-sensitive emulsions, it is often difficult to give an absorption peak at a specific wavelength or to control a shape of spectral sensitivity for a specific application.

It is preferable that the regular crystal grains of this invention are formed in the presence of a compound represented by following formula (I) or formula (II) to be presented later (Japanese patent application (OPI) No. 63-25643 PP. 5 to 18).

(I)

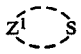

In formula (I), $Z^1$ represents an atom group required for forming a saturated or unsaturated heterocyclic ring together with a sulfur atom. This heterocyclic ring may have one or more substituting groups.

This atom group represented by $Z^1$ preferably comprises carbon, nitrogen, oxygen, and sulfur atoms. A heterocyclic ring formed by $Z^1$ and the sulfur atom is a 3- to 8-membered ring and may be condensed together with another ring to form a condensation ring.

The compound represented by formula (I) is preferably a colorless compound and does not have an absorption peak with a molecular absorbance coefficient of $10^3$ l.mol$^{-1}$.cm$^{-1}$ or more in a visible region (400 to 700 nm).

More specifically, examples of a heterocyclic ring which can be formed are thiirane, thiethane, thiane, thiepine, thiocyne, dihydrothiorane, thiophene, dihydrothiopyrane, 4H-thiopyrane, 2H-thiopyrane, 1,3-thiazylisine, thiazole, 1,3-oxathiorane, 1,3-dithiorane, 1,3-dithiolene, 1,4-oxathiane, 1,4-thiazane, 1,3-thiazane, benzothiorane, benzothiane, benzothiadilysine, and benzooxathiane.

Examples of a substituting group (to be referred to as R hereinafter) of heterocyclic ring formed by $Z^1$ and the sulfur atom are a halogen (fluorine, chlorine, or bromine), substituted or nonsubstituted (same as for a carbon- or nitrogen-containing group bonded to a hydrogen atom hereinafter) alkyl (preferably the number of carbon atoms is 1 to 20), aryl (preferably the number of carbon atoms is 6 to 20), alkoxy (preferably the number of carbon atoms is 6 to 20), aryloxy (preferably the number of carbon atoms is 6 to 20), alkylthio (preferably the number of carbon atoms is 1 to 20), arylthio (preferably the number of carbon atoms is 6 to 20), acyloxy (preferably the number of carbon atoms is 2 to 20), amino (nonsubstituted amino, preferably alkyl having 1 to 20 carbon atoms or secondary or tertiary amino substituted by aryl having 6 to 20 carbon atoms), carboneamido (preferably alkyl carboneamido having 1 to 20 carbon atoms or arylcarboneamido having 6 to 20 carbon atoms), ureido (preferably alkylureido having 1 to 20 carbon atoms or arylureido having 6 to 20 carbon atoms), carboxyl, carbonate (preferably alkyl carbonate having 1 to 20 carbon atoms or aryl carbonate having 6 to 20 carbon atoms), oxycarbonyl (preferably alkyloxycarbonyl having 1 to 20 carbon atoms or aryloxycarbonyl having 6 to 20 carbon atoms), carbamoyl (preferably alkylcarbamoyl having 1 to 20 carbon atoms or arylcarbamoyl having 6 to 20 carbon atoms), acyl (preferably alkylcarbonyl having 1 to 20 carbon atoms or arylcarbonyl having 6 to 20 carbon atoms), sulfo, sulfonyl (preferably alkylsulfonyl having 1 to 20 carbon atoms or arylsulfonyl having 6 to 20 carbon atoms), sulfinyl (preferably alkylsulfonyl having 1 to 20 carbon atoms and arylsulfonyl having 6 to 20 carbon atoms), sulfonamido (preferably alkylsulfonamido having 1 to 20 carbon atoms or arylsulfonamido having 6 to 20 carbon atoms), sulfamoyl (preferably alkylsulfamoyl having 1 to 20 carbon atoms or arylsulfamoyl having 6 to 20 carbon atoms), cyano, hydroxyl, nitro, oxo, thioxo, imino, and selenoxo. When alkyl to selenoxo groups can be substituted, these groups may be substituted by a substituting group selected from the above R substituting groups. When two or more substituting groups are present, they may be either the same or different.

Of the compounds represented by formula (I), a preferable one can be represented by following formula (IA).

(IA)

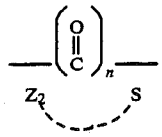

In formula (IA), $Z^2$ represents an atom group required for forming a 5- to 6-membered saturated or unsaturated heterocyclic ring together with a sulfur atom and a carbonyl group. This heterocyclic ring may have a substituting group. In this case, the substituting groups of the heterocyclic ring formed by $Z^2$, the sulfur atom, and the carbonyl group are the same as those of the atom groups represented by $Z^1$ and of the heterocyclic ring formed by $Z^1$ and the sulfur atom, respectively, in formula (I).

In formula (IA), n represents 1 to 3. When n is 2 or 3, the respective carbonyl groups may or may not be adjacent to each other.

Examples of the 5- to 6-membered saturated or unsaturated heterocyclic ring represented by formula (IA) are listed in Table 6 to be presented later. In Table 6, reference symbol R represents a hydrogen atom or an allowable substituting group represented by R described above.

Of the compounds represented by formula (IA), a compound, wherein a carboxyl group is combined with a sulfur atom, and the heterocyclic ring is saturated, is particularly preferred.

Examples of compounds represented by formula (IA) used in the invention are listed in Table 7.

Many of the compounds in this invention are commercially available, and the other compounds can be synthesized by a method described in U.S. patent application No. 07/065,444 filed on June 23, 1987 by H. Mifune et al.

A compound represented by formula (II) will be described in aformentioned U.S. patent application No. 07/065,444.

$$R_1—S—(X)_m—Y—R_2 \quad \text{(II)}$$

wherein X represent an organic group having a valency of 2 and constituted using alkylene, allylene, alkenylene, $$—SO_2—,\ —SO—,\ —\underset{\underset{O}{\|}}{C}—,\ —S—,\ —C—,\ \text{and}\ —\overset{R^3}{\overset{|}{N}}—$$

singly or in a combination. Alkylene, allylene, and alkenylene may have a substituting group, and allowable examples of the substituting group are represented by $R_1$ below.

$R_3$ represents hydrogen, alkyl, and aryl. Alkyl and aryl may have one or more substituting groups.

m represents 0 or 1.

$R_1$ represents hydrogen, alkali metal, alkali earth metal, substituted or nonsubstituted alkyl (preferably the number of carbon atoms is 1 to 20), substituted or nonsubstituted aryl (preferably the number of carbon atoms is 6 to 20), and substituted or nonsubstituted heterocyclic ring group having an N, S, or O atom. Preferable examples of $R_1$ are hydrogen and substituted or nonsubstituted alkyl (preferably the number of carbon atoms is 1 to 5). Examples of the substituting group on $R_1$ are halogen, alkyl, aryl, alkoxy, aryloxy, sulfonyl, sulfonamido, amido, acyl, sufamonyl, carbamoyl, ureido, alkoxycarbonylamino, aryloxycarbonylamino, alkoxycarbonyl, aryloxycarbonyl, aminocarbonylthio, alkylcarbonylthio, arylcarbonylthio, cyano, hydroxyl, mercapto, carboxy, sulfo, nitro, amino, alkylthio, arylthio, and heterocyclic hydrogen. Most preferable examples of $R_1$ are hydrogen and substituted or nonsubstituted lower alkyl or phenyl.

$R_2$ represents hydroxyl, substituted or nonsubstituted alkyl, substituted or nonsubstituted aryl, substituted or nonsubstituted heterocyclic ring, substituted or nonsubstituted amino, alkoxy, and aryloxy. As substituting groups on $R_2$, those of $R_1$ can be used. Preferable examples of $R_2$ are hydroxyl, substituted or nonsubstituted alkyl, and substituted or nonsubstituted amino.

Y represents —CO— or —$SO_2$—, and preferably, —CO—.

A total number of carbon atoms of an organic group, X, $R^1$, $R^2$, or $R^3$ including a substituting group portion is preferably 20 or less, respectively.

Examples of the compound represented by formula (II) used in this invention are summarized in Table 8 to be presented later. However, the present invention is not limited to these compounds.

When the compounds used in this invention are not commercially available, they can be easily synthesized. A synthesizing method will be described below.

For example, thiolcarboxylic acids can be synthesized by hydrolyzing thiolactones. Thiocarbamic acid esters can be easily synthesized by reacting isocyanate with thiol. Isocyanates can be synthesized by a method described in Organic Functional Group Preparations P. 301 (Academic Press). Thiols can be synthesized by a method described in Chem. Commumn , 435 (1969) or Chem. Lett., 187 (1974).

The compound represented by formula (I) or (II) of this invention can be added in an amount falling within the range of $2\times10^{-5}$ mol to $3\times10^{-1}$ mol, and preferably, $2\times10^{-4}$ mol to $1\times10^{-1}$ mol per mol of the silver halide.

The compound represented by formula (I) or (II) of this invention may be added at any timing before grain formation is finished. However, it is preferred that a part of the compound is present at the start of grain formation.

In a novel grain formation method found by the present inventors, crystal habit is controlled by means of promoting or suppressing generation of a specific plane of a grain in the presence of the specific compounds described above. These compounds are described in aforementioned U.S. patent application No. 07/065,444. According to this method, nuclei (initial grains) are formed under a chloride concentration of about 0.2 mol/liter or less, and grain formation is continuously performed in the presence of at least one compound represented by formula (I) or (II).

When the chloride concentration is about 0.2 mol/liter or less during nucleus formation, tabular grains (having two twinning planes) can be easily formed as the concentration is increased.

In this invention, the chloride concentration during grain formation is preferably 5 mol/liter or less, and more preferably, 0.07 to 3 mol/liter. A temperature during grain formation is 10° to 95° C., and preferably, 40° to 90° C. A pH during grain formation is not limited but preferably falls within the neutral to weakly acidic range.

In preparation of the silver halide grains of this invention, a silver halide solvent may be used.

Examples of the silver halide solvent are thiocyanate salt, thioether, and thiourea. Also, ammonia can be used as long as it does not adversely affect grain formation.

Examples are thiocyanate salt (e.g., U.S. Pat. Nos. 2,222,264, 2,448,534, and 3,320,069), thioether compound (e.g., U.S. Pat. Nos. 3,271,157, 3,574,628, 3,704,130, 4,297,439, and 4,276,347), thion compound (e.g., Japanese patent application (OPI) Nos. 53-144,319, 53-82,408, and 55-77,737), and an amine compound (e.g., Japanese patent application (OPI) No. 54-100,717).

During formation or physical ripening of the silver halide grains, cadmium salt, zinc salt, lead salt, thallium salt, iridium salt or its complex salt, rhodium salt or its complex salt, or iron salt or its complex salt may be used. Especially, iridium salt or rhodium salt is preferable.

In the manufacture of the silver halide grains of this invention, an addition rate, an addition amount, and an addition concentration of a silver salt solution (e.g., an aqueous $AgNO_3$ solution) and a halide solution (e.g., an aqueous NaCl solution) are preferably increased.

Examples of this method are described in British Patent No. 1,335,925, U.S. Pat. Nos. 3,672,900, 3,650,757, 4,242,445, Japanese patent application (OPI) Nos. 55-142,329, 55-158,124, 58-113,927, 58-113,928, 58-111,934, and 58-111,936.

b 1-5. Chemical Sensitization

The regular crystal silver halide emulsion of this invention need not be chemically sensitized but can be chemically sensitized as needed.

Chemical sensitization methods which can be used are a gold sensitization method using a gold compound (e.g., U.S. Pat. Nos. 2,448,060 and 3,320,069), a sensitization method using a metal such as iridium, platinum, rhodium, or palladium (e.g., U.S. Pat. Nos. 2,448,060, 2,556,245, and 2,566,263), a sulfur sensitization method using a sulfur-containing compound (e.g., U.S. Pat. No. 2,222,264), a selenium sensitization method using a selenium compound, a reduction sensitization method using stannates, thiourea dioxide, or polyamine (e.g., U.S. Pat. Nos. 2,487,850, 2,518,698, and 2,521,925), or a combination of at least two methods described above.

As for the silver halide grains of this invention, gold sensitization, a combination of gold sensitization and sulfur sensitization, or a combination of gold sensitization and reduction sensitization is preferable, and gold-plus-sulfur sensitization is most preferable.

The amount of the gold sensitizer is preferably $5\times10^{-6}$ mol or more per one mol of silver halide, and more preferably $1.5\times10^{-5}$ mol or more. The amount of the sulfur sensitizer used together with the gold sensitizer can be properly selected according to conditions such as a grain size, a chemical sensitization temperature, pAg, and pH and is $10^{-7}$ to $10^{-3}$ mol per one mol of silver halide, preferably $5\times10^{-7}$ to $10^{-4}$ mol, and more preferably $5\times10^{-7}$ to $10^{-5}$ mol. When gold-plus-sulfur sensitization is to be performed, chemical sensitization is preferably performed in the presence of the sulfur sensitizer and 250 mol % or more (with respect to the sulfur sensitizer) of the gold sensitizer.

Examples of a typical preferable gold sensitizer are a chloroauric acid and chloroaurate. As described in "James' Book", page 155, a gold sensitization effect can be effectively enhanced using thiocyanate salt.

Examples of the sulfur sensitizer used in this invention are sodium thiosulfate, thioureas such as tetramethylthiourea, and rhodanine compound.

This invention is characterized in that chemical sensitization is performed using the gold sensitizer in an amount larger than a normal amount, thereby increasing a sensitivity/fogging ratio.

The regular crystal silver halide emulsion of this invention may be treated using an oxidizing agent a needed after grain formation. This method is described in Japanese patent application (OPI) No. 60-136,736 (corresponding European Patent No. 144990A2). Although inorganic and organic oxidizing agents are present, hydrogen peroxide is typical and effective to deactivate an effect of the compound represented by formula (I) or (II) which is added during grain formation. More specifically, hydrogen peroxide can eliminate dye adsorption inhibition, chemical sensitization inhibition, a development restraining effect, or the like which the crystal habit controlling agent represented by formula (I) or (II) obtains after grain formation. The amount of the oxidizing agent is 1/10 to 10 times that in molar ratio of the used crystal habit controlling agent and the silver halide emulsion. The oxidizing agent is preferably used before chemical ripening. A detailed method is described in the patent specifications cited in this paragraph.

1-6. Spectral Sensitization

The regular crystal silver halide emulsion of this invention may be spectrally sensitized by methine dyes or the like. Examples of the dye are cyanine dye, merocyanine dye, complex cyanine dye, complex merocyanine dye, holopolar cyanine dye, hemicyanine dye, styryl dye, and hemioxonole dye. Most effective dyes are those belonging to cyanine dye, merocyanine dye, and complex merocyanine dye. Any nucleus normally used in the cyanine dye or the like as a basic heterocyclic ring nucleus can be used in these dyes. Examples of the nucleus are pyrroline, oxazoline, thiazoine, pyrrole, oxazole, thiazole, selenazole, imidazole, tetrazole, and pyridine; nuclei obtained by condensed alicyclic hydrocarbon ring to the above nuclei; and nuclei obtained by condensed aromatic hydrocarbon ring to the above nuclei, i.e., indolenine, benzindolenine, indole, benzoxadole, naphthoxazole, benzothiazole, naphtothiazole, benzoselenazole, benzimidazole, and quinoline. These nuclei may be substituted on a carbon atom.

Examples of a nucleus used in the merocyanine dye or the complex merocyanine dye are 5- and 6-membered ring nuclei having a ketomethylene structure such as a pyrazoline-5-one, thiohydantoin, 2-thiooxazolidine-2,4-dione, thiazolidine-2,4-dione, rhodanin and thiobarbituric acid.

For example, the compounds described in Research Disclosure, Item 17643, Page 23, Section IV (Dec. 1978) or the compounds described in the references cited therein can be used.

A typical example is the following methine dye.

Formula (IIIa)

Formula (IIIa)

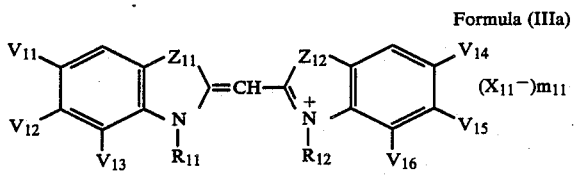

In the above formula, $Z_{11}$ represents an oxygen, sulfur, or selenium and $Z_{12}$ represents sulfur or selenium.

$R_{11}$ and $R_{12}$ each represent alkyl or alkenyl which has six carbon atoms or less and may be substituted At least one of $R_{11}$ or $R_{12}$ represents sulfo-substituted alkyl, and most preferably, at least one of them represents 3-sulfopropyl, 2-hydroxy-3-sulfopropyl, 3-sulfobutyl, or sulfoethyl. Examples of a substituting group are alkoxy having four carbon atoms or less, halogen, hydroxyl, and carbamoyl, phenyl which have eight carbon atoms or less and may be substituted, carboxy, and sulfo and alkoxycarbonyl having five carbon atoms or less. Examples represented by $R_{11}$ and $R_{12}$ are methyl, ethyl, propyl, allyl, pentyl, hexyl, methoxyethyl, ethoxyethyl, phenethyl, 2-p-tolylethyl, 2-p-sulfophenethyl, 2,2,2-trifluoroethyl, 2,2,3,3-tetrafluoropropyl, carbamoylethyl, hydroxyethyl, 2-(2-hydroxyethyl)ethyl, carboxymethyl, carboxyethyl, ethoxycarbonylmethyl, 2-sulfoethyl, 2-chloro-3-sulfopropyl, 3-sulfopropyl, 2-hydroxy-3-sulfopropyl, and 3- or 4-sulfobutyl.

When $Z_{11}$ represents oxygen, $V_{11}$ and $V_{13}$ represent hydrogen, and $V_{12}$ represents phenyl, alkyl having 3 carbon atoms or less or alkoxy having 3 carbon atoms or less or phenyl substituted by chlorine (more preferably, $V_{12}$ is phenyl), and also represents that $V_{11}$ and $V_{12}$, or $V_{12}$ and $V_{13}$ can be coupled to form a condensed benzene ring. Most preferably, $V_{11}$ and $V_{13}$ represent hydrogen, and $V_{12}$ represent phenyl.

When $Z_{11}$ represents sulfur or selenium, $V_{11}$ represents alkyl or alkoxy each having four carbon atoms or less, or hydrogen, $V_{12}$ represents alkyl having five carbon atoms or less, alkoxy having four carbon atoms or less, chlorine, hydrogen, phenyl which may be substituted (e.g., tolyl, anisyl, and phenyl) or hydroxyl, and $V_{13}$ represents hydrogen and also represents that $V_{11}$ and $V_{12}$, or $V_{12}$ and $V_{13}$ can be coupled to form a condensation benzene ring. More preferably, $V_{11}$ and $V_{13}$ represent hydrogen and $V_{12}$ represents alkoxy having four carbon atoms or less, phenyl, or chlorine; $V_{11}$ represents alkoxy or alkyl, each having four carbon atoms or less and $V_{12}$ represents hydroxyl or alkyl having four carbon atoms or less; or $V_{12}$ and $V_{13}$ are coupled to form a condensed benzene ring.

When $Z_{12}$ represents selenium, $V_{14}$, $V_{15}$, and $V_{16}$ represent the same meanings as those represented by $V_{11}$, $V_{12}$, and $V_{13}$ when $Z_{11}$ represents selenium, respectively. When, $Z_{14}$ represents sulfur and $Z_{11}$ represents selenium, $V_{14}$ represents hydrogen, alkoxy having four carbon atoms or less, or alkyl having five carbon atoms or less, $V_{15}$ represents alkoxy having four carbon atoms or less, phenyl which may be substituted (preferably phenyl such as tolyl or anisyl), alkyl having four carbon atoms or less, chlorine, or hydroxyl, and $V_{16}$ represents hydrogen and also represents that $V_{14}$ and $V_{15}$ or $V_{15}$ and $V_{16}$ can be coupled to form a condensed benzene ring. More preferably, $V_{14}$ and $V_{16}$ represent hydrogen, $V_{15}$ represents alkoxy having four carbon atoms or less, chlorine, or phenyl, and $V_{15}$ and $V_{16}$ are coupled to form a condensed benzene ring. When both $Z_{11}$ and $Z_{12}$ represent sulfur, $V_{14}$ and $V_{16}$ represent hydrogen, $V_{15}$ represents phenyl which may be substituted (e.g., phenyl or tolyl), and $V_{14}$ represents hydrogen and also represents that $V_{15}$ and $V_{16}$ can be coupled to form a condensation benzene ring. When $Z_{11}$ represents oxygen and $Z_{12}$ represents sulfur, $V_{14}$ and $V_{16}$ represent hydrogen, and $V_{15}$ represents chlorine, phenyl which may be substituted, or alkoxy having four carbon atoms or less and also represents that $V_{15}$ and $V_{16}$ can be coupled to form a condensed benzene ring. More preferably, $V_{14}$ and $V_{16}$ represent hydrogen and $V_{15}$ represents phenyl, or $V_{15}$ and $V_{16}$ are coupled to represent a condensed benzene ring.

$X^-_{11}$ represents anion residue of acid.

$m_{11}$ represents 0 or 1, and in the case of an inner salt, represents 1.

Formula (IIIb)

Formula (IIIb)

-continued

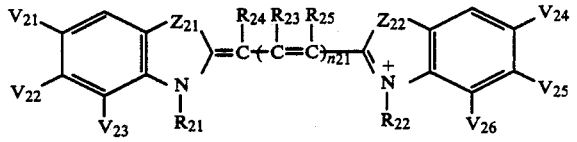

$(X_{21})_{m21}$

In the above formula, $Z_{21}$ or $Z_{22}$ may be the same or different and represents oxygen, sulfur, selenium, or

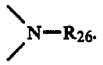

$R_{21}$ and $R_{22}$ represent the same meanings as those represented by $R_{11}$ and $R_{12}$ of formula IIIa, and also represent that $R_{21}$ and $R_{24}$ or $R_{22}$ and $R_{25}$ can be coupled to form a 5- or 6-membered carbon ring. When $n_{21}$ represents 2 or 3, $R_{21}$ and $R_{22}$ do not represent a substituting group having sulfo at the same time.

When at least one of $Z_{21}$ and $Z_{22}$ represents

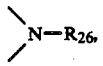

$R_{23}$ represents hydrogen, and otherwise, represents lower alkyl or phenethyl. When $n_{21}$ represents 2 or 3, $R_{23}$ represents that different $R_{23}$ and $R_{23}$ can be coupled to form a 5- or 6-membered ring.

$R_{24}$ and $R_{25}$ represent hydrogen.

$R_{26}$ and $R_{27}$ represent the same meanings as that represented by $R_{21}$ or $R_{22}$ and also represent that $R_{21}$ $R_{26}$ do not represent a substituting group having sulfo at the same time and that $R_{22}$ and $R_{26}$ represent a substituting group having sulfo at the same time.

When $Z_{21}$ represents oxygen, $V_{21}$ represents hydrogen. When $Z_{21}$ represents sulfur or selenium, $V_{21}$ represents hydrogen, or an alkyl or alkoxy group having five carbon atoms or less. When $Z_{21}$ represents

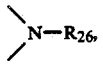

$V_{21}$ represents hydrogen or chlorine.

When $Z_{21}$ represents oxygen and $Z_{22}$ represents

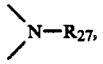

$V_{22}$ represents hydrogen, alkyl or alkoxy, each having five carbon atoms or less, chlorine, or phenyl which may be substituted (e.g., tolyl, anisyl, or phenyl) and also represents that $V_{22}$ can be coupled to $V_{21}$ or $V_{23}$ to form a condensed benzene ring (more preferably, $V_{22}$ represents alkoxy or phenyl, or $V_{21}$ and $V_{22}$ or $V_{22}$ and $V_{23}$ are coupled to form a condensed benzene ring). When $Z_{21}$ and $Z_{22}$ mainly represent oxygen, $V_{22}$ represents phenyl which may be substituted (e.g., tolyl, anisyl, or phenyl, and more preferably, phenyl) or represents that $V_{22}$ can be coupled to $V_{21}$ or $V_{23}$ to form a condensed benzene ring. When $Z_{21}$ represents sulfur or selenium, $V_{22}$ represents hydrogen, alkyl or alkoxycarbonyl, each having five carbon atoms or less, alkoxy or acylamino, each having four carbon atoms or less, chlorine, or phenyl which may be substituted (more preferably, alkyl or alkoxy having four carbon atoms or less, chlorine, or phenyl) and also represents that $V_{22}$ can be coupled to $V_{23}$ to form a condensation benzene ring. When $Z_{21}$ represents

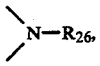

$V_{22}$ represents chlorine, trifluoromethyl, cyano, alkylsulfonyl having four carbon atoms or less, or alkoxycarbonyl having five carbon atoms or less (more preferably, when $Z_{21}$ represents

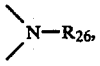

$V_{21}$ represents chlorine, and $V_{22}$ represents chlorine, trifluoromethyl, or cyano).

$V_{23}$ represents hydrogen.

$V_{24}$ represents the same meaning as that represented by $V_{21}$ when $Z_{22}$ represents an atom type corresponding to that represented by $Z_{21}$.

When $Z_{22}$ represents oxygen, $V_{25}$ represents alkoxy having four carbon atoms or less, chlorine, or phenyl which may be substituted (e.g., anisyl, tolyl, or phenyl) or represents that $V_{25}$ can be coupled to $V_{24}$ or $V_{26}$ to form a condensed benzene ring. When $Z_{21}$ represents

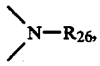

$V_{25}$ preferably represents alkoxy having four carbon atoms or less or phenyl or represents that $V_{25}$ can be coupled to $V_{24}$ or $V_{26}$ to form a condensed benzene ring. When $Z_{21}$ represents oxygen, sulfur, or selenium, $V_{25}$ preferably represents phenyl or represents that $V_{25}$ can be coupled to $V_{24}$ or $V_{26}$ to form a condensed benzene ring. When $Z_{22}$ represents

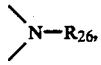

$V_{25}$ represents the same meaning as that represented by $V_{22}$ when $Z_{21}$ represents

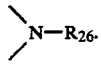

When $Z_{22}$ represents sulfur or selenium, $V_{25}$ represents the same meaning as that represented by $V_{22}$ when $Z_{21}$ represents sulfur or selenium.

$V_{26}$ represents hydrogen.

$X_{21}^-$ represents anion residue of acid.

$m_{21}$ represents 0 or 1, and in the case of an inner salt, represents 0.

$n_{21}$ represents 1, 2, or 3.

Formula (IIIc)

Formula (IIIc)

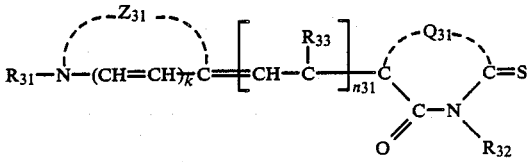

In formula IIIc, $Z_{31}$ represents an atom group for forming nuclei such as thiazoline, thiazole, benzothiazole, naphtholthiazole, selenazoline, selenazole, benzoselenazole, naphthoselenazole, benzimidazole, naphthoimidazole, oxazole, benzoxazole, naphthooxazole, or pyridine. These heterocyclic nuclei may be substituted. In order to from benzimidazole or naphthomidazole, examples of a substituting group on nitrogen at the 1-position which is not $R_{31}$ are those listed as $R_{26}$ or $R_{27}$ of formula IIIb. Examples of a substituting group on a condensed benzene ring of benzimidazole are chlorine, cyano, alkoxycarbonyl having five carbon atoms or less, alkylsulfonyl having four carbon atoms or less, or trifluoromethyl. Preferably, the 5-position is substituted by chlorine and the 6-position is substituted by cyano, chlorine, or trifluoromethyl. Examples of a substituting group on heterocyclic nuclei other than benzimidazole, selenazoline, and thiazoline nuclei are alkyl having eight carbon atoms or less which may be substituted (e.g., hydroxy, chlorine, fluorine, alkoxy, carboxy, alkoxycarbonyl, phenyl, or substituted phenyl), hydroxyl, alkoxycarbonyl having five carbon atoms or less, halogen, carboxy, furyl, thienyl, pyridyl, phenyl, or substituted phenyl (e.g., tolyl, anicyl, or chlorophenyl). Examples of a substituting group on a selenazoline or thiazoline nucleus are alkyl having six carbon atoms or less, hydroxyalkyl or alkoxycarbonylalkyl, each having five carbon atoms or less.

$R_{31}$ represents the same meaning as that represented by $R_{11}$ or $R_{12}$ of formula (IIIa).

$R_{32}$ represents the same meaning as that represented by $R_{11}$ or $R_{12}$ of formula (IIIa), and also represents hydrogen, furfuryl, or monocyclic aryl which may be substituted (e.g., phenyl, tolyl, anicyl, carboxyphenyl, hydroxyphenyl, chlorophenyl, sulfophenyl, pyridyl, 5-methyl-2-pyridyl, 5-chloro-2-pyridyl, thienyl, or furyl), and also represents that at least one of $R_{31}$ and $R_{32}$ is a substituting group having sulfo or carboxy and the other is a group not containing sulfo.

$R_{33}$ represents alkyl having five carbon atoms or less, phenethyl, phenyl, 2-carboxyphenyl, and when n represents 2 or 3, represents that different $R_{33}$ and $R_{33}$ can be coupled to form a 5- or 6-membered ring.

$Q_{31}$ represents oxygen, sulfur, selenium, or

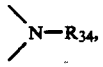

and when $Z_{31}$ represents atom group for forming thiazoline, selenazoline, or oxazole nucleation, preferably represents sulfur, selenium, or

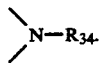

$R_{34}$ represents hydrogen, pyridil, phenyl, substituted phenyl (e.g., tolyl or anicyl) or an aliphatic hydrocarbon group having eight carbon atoms or less which may contain oxygen, sulfur, or nitrogen in a carbon chain or may contain a substituting group for hydroxyl, halogen, alkyl aminocarbonyl, alkoxycarbonyl, and phenyl, and more preferably, represents hydrogen, phenyl, pyridyl, or alkyl which may contain an oxygen atom in a carbon chain or may contain hydroxyl.

k represents 0 or 1, and n31 represents 0, 1, 2, or 3.

Examples of a compound of a spectral sensitizing dye preferably used in this invention are summarized in Table 9.

The regular crystal grains of the invention are, preferably, spectrally sensitized with at least one of sensitizing dyes represented by the formulas (IIIa), (IIIb), and (IIIc).

A dye may be added in an emulsion at any timing conventionally known to be effective in emulsion preparation. Most ordinarily, the dye is added after chemical sensitization is completed and before coating is performed. However, as described in U.S. Pat. Nos. 3,628,969 and 4,225,666, the dye can be added at the same time a chemical sensitizing agent is added to simultaneously perform spectral sensitization and chemical sensitization. Also, the dye can be added prior to chemical sensitization as described in Japanese patent application (OPI) No. 58-113,928, or can be added to start spectral sensitization before generation of silver halide grain precipitation is completed. Furthermore, as described in U.S. Pat. No. 4,225,666, one of these compounds can be added twice, i.e., a part of the compounds can be added prior to chemical sensitization, and the remaining part can be added thereafter. Thus any timing during silver halide grain formation as described in U.S. Pat. No. 4,183,756 can be used.

The amount of the dye may be $1\times10^{-6}$ to $8\times10^{-3}$ mol per mol of the silver halide. However, when a silver halide grain size is more preferable, i.e., 0.2 to 1.2 μm, about $5\times10^{-5}$ to $2\times10^{-3}$ mol is more effective.

The regular crystal grains are preferably spectrally sensitized by at least one blue spectral sensitizing dye. That is, the regular crystal silver halide emulsion of this invention is preferably spectrally sensitized in a blue region and used in a blue-sensitized emulsion layer. In this case, "spectrally sensitized to a blue range" means that a spectral sensitizing dye having at least one absorption peak in the region of 400 to 500 nm, preferably, 430 to 490 nm, and more preferably, 445 to 490 nm when it is adsorbed to emulsion grains of this invention is used. Examples of the blue spectral sensitizing dye are compounds represented by formulas (IIIa) and (IIIc) in which $n_{31}=0$. More specifically, examples of the compound are those represented by formulas III-1 to III-8 and III-29 to III-32.

1-7. Additives

When a compound having a mercapto group is added to the regular crystal silver halide emulsion of this invention, the emulsion can reduce fog of a light-sensitive material, improve storage stability before exposure, and improve stability over time of an emulsion coating liquid before light-sensitive material manufacture.

For this purpose, tetrazaindene is normally used, and a mercapto-containing compound must be used in a small limited amount. It is assumed that when the compound is used in an amount below an optimal range, it is ineffective, and that when the amount exceeds the optimal range, it adversely affects, e.g., desensitizes. For the above purpose, although unexpected, it is preferable to add the mercapto compound which is assumed to have a strong restraining effect to the emulsion of this invention, resulting in less desensitization and development restraint.

The mercapto-containing compound of this invention can be represented by formula (IV):

Formula (IV)

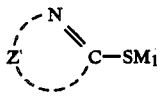

Formula (IV)

In formula (IV), $M_1$ represents a protective group for mercapto which is cleaved by hydrogen, cation, or alkali, and Z represents an atom group required for forming a 5- or 6-membered heterocyclic ring. This heterocyclic ring may have a substituting group or may be condensed. More specifically, $M_1$ represents hydrogen, cation or protective group for mercapto (e.g., —COR', —COOR', and —$CH_2CH_2$COR' wherein R' is hydrogen, alkyl, aralkyl, aryl, and the like) which is cleaved by alkali (e.g., sodium ion, potassium ion, and ammonium ion).

Z represents atom group required for forming a 5- or 6-membered heterocyclic ring. This heterocyclic ring may contain sulfur, selenium, nitrogen, oxygen, or the like as a heterocyclic atom, may be condensed, or may have a substituting group on a heterocyclic ring or a condensation ring.

Examples of Z are tetrazole, triazole, imidazole, oxazole, thiadiazole, pyridine, pyrimidine, triazine, azabenzimidazole, purine, tetraazaindene, triazaindene, pentaazaindene, benstriazole, benzimidazole, benzoxazole, benzthiazole, benzselenazole, and naphthoimidazole. Examples of a substituting group on the above rings are alkyl (e.g., methyl, ethyl, n-hexyl, hydroxyethyl, and carboxyethyl), alkenyl (e.g., allyl), aralkyl (e.g., benzyl and phenethyl), aryl (e.g., phenyl, naphthyl, p-acetamidophenyl, p-carboxyphenyl, m-hydroxyphenyl, p-sulfamoylephenyl, p-acetylphenyl, o-methoxyphenyl, 2,4-diethylaminophenyl, and 2,4-dichlorophenyl), alkylthio (e.g., methylthio, ethylthio, and n-butylthio), arylthio (e.g., phenylthio and naphthylthio), aralkylthio (e.g., benzylthio), and mercapto. Especially the condensation ring, may be substituted by nitro, amino, halogen, carboxyl, or sulfo in addition to the above substituting groups.

An amount of the above mercapto-containing compound is preferably $10^{-3}$ mol or less per mol of the silver halide.

Examples of a nitrogen-containing heterocyclic compound having mercapto are summarized in Table 10.

(2) DYE IMAGE FORMING AGENT

2-1. Color Coupler

In this invention, various color couplers can be used. Specific examples of these couplers are described in above-described *Research Disclosure,* No. 17643, VII-C to VII-G as patent references. As dye-forming couplers, couplers giving three primary colors (i.e., yellow, magenta, and cyan) by subtraction color process by color development are typically important. The photographic light sensitive material of the invention preferably contains at least one yellow coupler, at least one magenta coupler, and at least one cyan coupler. Specific examples of non-diffusible couplers, four-equivalent couplers, and two-equivalent couplers are described in Patents referred in above-described Research Disclosure, No. 17643, VII-C and VII-D and further the following couplers can be also preferably used in this invention.

Typical yellow couplers which can be used in this invention include hydrophobic acetylacetamide series couplers having a ballast group. Specific examples of the yellow coupler are described in U.S. Pat. Nos. 2,407,210, 2,875,057 and 3,265,506. In this invention, the use of two-equivalent yellow couplers is preferred. Typical examples thereof are the oxygen atom-releasing type yellow couplers described in U.S. Pat. Nos. 3,408,194, 3,447,928, 3,933,501, 4,022,620, 4,157,919, and 4,401,752, and Japanese patent application (OPI) Nos. 174,839/84 and 214,854/84, and the nitrogen atom-releasing type yellow couplers described in Japanese Patent Publication 10,739/83, U.S. Pat. Nos. 4,146,396, 4,326,024, *Research Disclosure,* No. 18053 (April, 1979), British Patent No. 1,425,020, West German Patents (OLS) Nos. 2,219,917, 2,261,361, 2,329,587 and 2,433,812. Furthermore, α-pivaloylacetanilide series couplers are excellent in fastness, in particular light fastness of the colored dye. On the other hand, α-benzoylacetanilide series couplers show high coloring density.

Typical magenta couplers which can be used in this invention include hydrophobic indazolone type or cyanoacetyl series, preferably 5-pyrazolone type and pyrazoloazole series couplers each having a ballast group. The 5-pyrazolone series couplers the 3-position of which is substituted by an arylamino group or an acylamino group are preferred in the view points of the hue and coloring density of the colored dye. Specific examples of such couplers are described in U.S. Pat. Nos. 2,311,082, 2,343,703, 2,600,788, 2,908,573, 3,062,653, 3,152,896, 3,936,015, etc. As the releasable group of a two-equivalent 5-pyrazolone type coupler, the nitrogen atom releasing group described in U.S. Pat. No. 4,310,619 and the arylhio group described in U.S. Pat. No. 4,351,897 are particularly preferred. Also, the 5-pyrazolone type couplers having ballast group described in European Patent No. 73,636 give high coloring density. As the pyrazoloazole type magenta couplers, there are the pyrazolobenzimidazoles described in U.S. Pat. No. 3,061,432, preferably the pyrazolo [5,1-c] [1,2,4] triazoles described in U.S. Pat. No. 3,725,067, the pyrazolotetrazoles described in *Research Disclosure,* RD No. 24220 (June, 1984) and Japanese patent application (OPI) No. 33,552/85, and the pyrazolopyrazoles described in *Research Disclosure,* RD No. 24230 (June, 1984) and Japanese patent application (OPI) No. 43,659/85. With respect to the points of showing less side yellow absorption and light fastness of the colored dye, the imidazo [1,2-b] pyrazoles described in U.S. Pat. No. 4,500,630 are preferred and the pyrazolo [1,5] [1,2,4] triazolos described in U.S. Pat. 4,540,654 are particularly preferred.

Typical cyan couplers which can be used in this invention include hydrophobic and non-deffusible naphtholic and phenolic couplers. Typical examples of the cyan couplers are the naphtholic couplers described in U.S. Pat. No. 2,474,293 and preferably the oxygen atom releasing type two-equivalent naphtholic couplers described in U.S. Pat. Nos. 4,052,212, 4,146,396, 4,228,233, and 4,296,200. Also, specific examples of the phenolic couplers are described in U.S. Pat. Nos. 2,369,929, 2,801,171, 2,772,162, 2,895,8926, etc.

Couplers capable of forming a cyan dye having fastness to humidity and temperature are preferably used in this invention and specific examples of such cyan couplers are the phenolic cyan couplers having an alkyl group of at least 2 carbon atoms at the metaposition of the phenol nucleus described in U.S. Pat. No. 3,772,002, the 2,5-diacylamino-substituted phenolic couplers described in U.S. Pat. Nos. 2,772,162, 3,758,308, 4,124,396, 4,334,011, 4,327,173, West German Patent application (OLS) No. 3,329,729, and European Patent No. 121,365, and the phenolic couplers having a phenylureido group at the 2-position thereof and an acylamino group at the 5-position thereof described in U.S. Pat. Nos. 3,446,622, 4,333,999, 4,451,559 and 4,427,767. A cyan coupler obtained by substituting a sulfonamido group or an amido group at the 5-position of naphthol and described in European Pat. No. 161,626A provides a color image which is excellent in light-fastness and can be preferably used in this invention.

2-2. Functional Coupler

For correcting additional, undesirable absorption of colored dye, it is preferred to perform color masking by using colored couplers together in the case of color photographic materials for in-camea use. Specific examples of these colored couplers are the yellow-colored magenta couplers described in U.S. Pat. No. 4,163,670 and Japanese Patent Publication No. 39,413/82, and the magenta-colored cyan couplers described in U.S. Pat. Nos. 4,004,929, 4,138,258 and British Patent No. 1,146,368. Other colored couplers which can be used in this invention are described in above-described *Research Disclosre,* RD No. 17643, VII-G.

A masking agent having as a releasable group a legend capable of forming a chelate dye, as described in U.S. Pat. Nos. 4,553,477, 4,555,478, 4,557,998, and 4,568,633, can be preferably used in the present invention.

In this invention, the graininess can be improved by using together couplers capable of forming colored dyes having proper diffusibility. As such couplers, specific examples of magenta couplers are described in U.S. Pat. No. 4,366,237 and British Patent No. 2,125,570 and specific examples of yellow couplers, magenta couplers and cyan couplers are described in European Patent No. 96,570 and West German patent application (OSL) No. 3,234,533.

The dye-forming couplers and the above-describe specific couplers each may form a dimer or higher polymers. Typical examples of the polymerized dye-forming couplers are described in U.S. Pat. No. 3,451,820, 4,080,211, and 4,455,366. Also, specific examples of the polymerized magenta couplers are described in British Patent No. 2,102,173 and U.S. Pat. Nos. 4,367,282 and 3,926,436. Water-soluble polymer couplers described in Japanese patent application (OPI) Nos. 218,646/85 and 28,744/83 and U.S. Pat. Nos. 4,207,109 and 4,215,195 are preferably used in the present invention.

Couplers releasing a photographically useful residue upon coupling are preferably used in this invention. DIR couplers, i.e., couplers releasing development inhibitor are described in the patents cited in abovedescribed Research Disclosure, No. 17643, VII-F.

Preferred examples of these couplers which can be used in this invention are the developer inactivating type couplers described in Japanese patent application (OPI) No. 151,944/82, the timing type couplers described in U.S. Pat. No. 4,248,962 and Japanese patent application (OPI) No. 154,234/82, the reaction type couplers described in Japanese patent application (OPI) No. 184,248/85, etc. Particularly preferred examples of these couplers are the development in activating type DIR couplers described in Japanese patent application (OPI) Nos. 151,944/82, 217,932/83, Japanese patent application (OPI) Nos. 218,644/85, 25,156/85, 233,650/85, etc., and the reaction type DIR couplers described in Japanese patent application (OPI) No. 39,653/84, etc.

For the photographic light-sensitive materials of this invention, couplers imagewise releasing a nucleating agent or a development accelerator or a precursor thereof at development can be used. Specific examples of these couplers are described in British Patents Nos. 2,097,140 and 2,131,188. Also, couplers releasing a nucleating agent having an adsorptive action for silver halide are particularly preferred in this invention and specific examples thereof are described in Japanese patent application (OPI) Nos. 157,638/84 and 170,840/84.

Other couplers which can be used in the photographic light-sensitive material of the present invention are a competitive coupler (e.g., a coupler described in U.S. Pat. No. 4,130,427), multi-equivalent couplers (e.g., couplers described in U.S. Pat. Nos. 4,238,472, 4,338,393, and 4,310,618), coupler releasing a DIR redox compound (e.g., a coupler described in Japanese patent application (OPI) No. 60-185,950), and a coupler releasing a dye which turned a colored form after being released (e.g., a coupler described in European Pat. No. 173,302A).

Furthermore, couplers releasing bleach accelerator described in Japanese patent application (OPI) No. 61-201,247, *Research Disclosure* Nos. 11,449 (October, 1973) and 24,241 (June, 1984) are preferably used to accelerate desilvering.

2-3. Additives

Typical scavengers of the oxidation product of a developing agent which ca be used in the present invention are preferably known hydroquinone derivatives, and compounds described in U.S. Pat. No. 4,474,874 Japanese patent application (OPI) No. 59-5,247, and U.S. Pat. Nos. 4,525,451, 4,584,264, and 4,447,523.

In addition to use of the DIR coupler for improving sharpness, an unsharp mask method is often used, as described in French Pat. No. 2,260,124 and Japanese patent application (OPI) Nos. 61-201,246 and 61-169,843.

2-4. Dispersion Method

The coupler used in the present invention can be introduced according to various known dispersion methods such as a solid dispersion method and an alkali dispersion method, preferably a latex method, and more preferably an oil-in-water dispersion method. According to the oil-in-water dispersion method, a coupler is dissolved in a high boiling organic solvent having a boiling point of 175° or more, an auxiliary solvent having a low boiling point, or a mixture thereof and is dispersed in water or an aqueous solution (e.g., an aqueous solution of gelatin) in the presence of a surfactant. Typical high boiling organic solvents are described in U.S. Pat. No. 2,322,027 and the like. Dispersion may accompany phase transition. The auxiliary solvent may be eliminated or reduced by distillation, noodle water-washing or ultrafiltration, and the resultant solvent is used for application.

The process, effect of the latex dispersion method and typical loadable latexes are described in U.S. Pat. No. 4,199,363, and West German patent application (OLS) Nos. 2,541,274 and 2,541,230.

2-5. Layer Structure and ISO Sensitivity

The photographic material according to the present invention is preferably used as a national color photographic light-sensitive material. For this purpose, silver halide is combined with couplers for providing complementary colors of color sensitivity of the silver halide. At least one blue sensitive silver halide emulsion layer containing a yellow coupler, at least one green-sensitive silver halide emulsion layer containing a magenta coupler, and at least one red sensitive silver halide emulsion layer containing a cyan coupler are formed on a transparent support to prepare a light-sensitive material for photographing. The photographic light sensitive material of the invention preferably has at least one blue-sensitive silver halide emulsion layer containing a yellow coupler, at least one green-sensitive silver halide emulsion layer containing a magenta coupler, and at least one red-sensitive silver halide emulsion layer containing a cyan coupler. The "for photographing" indicates for a film loaded in a portable camera and used.

The present invention can provide a high-speed negative type color photographic light-sensitive material for photographing, having the ISO sensitivity range of 25 to 3,200. The photographic light-sensitive material for photographing prepared by the present invention substantially does not contain silver iodide as in a silver halide used in conventional color paper and is suitable for simultaneous process for negative type and paper.

(3) DEVELOPMENT PROCESS

3-1. Color Developer

The photographic light-sensitive material of the invention is preferably color-developed in the presence of a color coupler. A color developer used in development of the photographic light-sensitive material according to the present invention is an alkaline aqueous solution containing an aromatic primary amine type color developing agent as a primary component. An aminophenol compound can be effectively used as an aromatic primary amine color developing agent. However, a p-phenylenediamine type compound is more suitable as the color developing agent, and its examples are 3-methyl-4-amino-N,N-diethylaniline, 3-methyl-4-amino- N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline; and sulfates, chlorates, phosphates, p-toluenesulfonates, tetraphenylborates, and p-(t-octyl)benzensulfonates of these compounds.

3-2. N-Hydroxyalkyl Substituted p-Phenylenediamine Derivatives

To simplify the development process and perform it at high speed, the developing agent should better have a high developing rate and result in small variations in development activation, with respect to the photographic light-sensitive material of the present invention, even replenishment are used in a small amount. A typical example of the preferable developing agent is 3-methyl-4-amino-N-ethyl-N-β-hydroxyethylaniline represented by formula (V):

Formula (V)

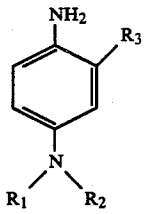

Formula (V)

wherein $R_1$ is hydrogen or alkyl (preferably the number of carbon atoms is 1 to 6); represents $(R_4O)m$-(R s) $R_2)_n$—$R_6$, wherein $R_4$ and $R_5$ represent the same or different alkylene groups (preferably the number of carbon atoms is 1 to 4), m and n independently represent an integer, 0 to 4, but m and n do not represent simultaneously 0, and $R_6$ represents hydrogen aryl (preferably the number of carbon atoms is 6 to 8), or alkyl (preferably the number of carbon atoms is 1 to 6); and $R_3$ represents hydrogen, halogen, alkyl, hydroxyl, alkoxy, alkylsulfonamido, acylamido, or amino. The number of carbon atoms of $R_3$ is preferably 1 to 4.

Examples of the compound represented by formula (V) are listed in Table 11.

The color development of the invention is preferably performed using N-hydroxylalkyl-substituted-p-phenylenediamine derivatives.

The content of the color developing agent is 1 g to 30 g per liter of the color developing solution and is preferably 2 g to 20 g, more preferably 3 g to 10 g.

The color developing agents of compounds represented by formula (V) are frequently used singly. However, color developing agents represented by the given formula or different formulas may be mixed. Examples of such mixtures are: a mixture of 3-methyl-4-amino-N-ethyl-N-β-hydroxyethylaniline and 3-ethyl-4-amino-N-β-methanesulfonamidoethylaniline; and a mixture of 3-methyl-4-amino-N-ethyl-N-β-methoxyethylaniline and 3-methyl-4-amino-N-ethyl-N-β-methanesulfonamidoethylaniline.

3-3. Additives for Color Development

The color developing solution may contain: a pH buffering agent such as carbonate, borate, or phosphate of alkali metal; a developing inhibitors or antifogging agents such as chloride, bromide, iodide, benzimidazole, benzothiazole, or mercapto compound; preservatives such as hydroxylamine, diethylhydroxylamine, triethanolamine, the compounds described in West German patent application (OLS) No. 2,622,950, a compound described in Japanese patent application No. 61-265,149, sulfite, or bisulfite; an organic solvents such as diethylene glycol; a development accelerator such as benzyl alcohol, polyethylene glycol, quaternary ammonium salt, amines, thiocyanate, 3,6-thiaoctane-1, 8-diol; competitive couplers; auxiliary developing agents such as 1-phenyl-3-pyrazolidone; thickfiers; and a chelate agent such as ethylenediamine tetraacetatic acid, nitrylotriacetic acid, cyclohexadiamine tetraacetatic acid, iminodiacetatic acid, hydroxyethyliminodiacetatic acid, N-hydroxymethylethylenediam:inetriacetatic acid diethylenetriaminepentacetatic acid, triethlenetetraminehexacetatic acid, aminopolycarboxylic acid such as the compounds described in Japanese patent application (OPI) No. 58-195,845, 1-hydroxyethylidene-1, 1'-diphophonic acid, an organic phosphonic acid described in *Research Disclosure* No. 18,170 (May, 1979), an aminophosphonic acids (e.g., aminotris(methylene phosphonic acid) ethylenediamine-N,N,N',N'-tetramethylenephosphonic acid, and phosphonocarboxylic acids described in Japanese patent application (OPI) Nos. 52-102,726, 53-42,730, 54-121,127, 55-4,024, 55-4,025, 55-126,241, 55-65,955, and 55-65,956, and *Research Disclosure* No. 18,710 (May, 1979).

The pH of the color developer falls within the range of 8 to 13, preferably 9 to 12, and most preferably 9.5 to 11.5. The process temperature in the present invention falls within the range of 25° to 50° C., preferably 30° to 50° C., and particularly preferably 35° to 45° C. in favor of rapid development.

For processing the photographic light-sensitive material of the present invention, the developer preferably contains $1\times10^{-3}$ mol/liter to $2\times10^{-1}$ mol/liter of a water-soluble chloride, and preferably $5\times10^{-3}$ mol/liter to $5\times10^{-2}$ mol/liter thereof. Preferable examples of the water-soluble chloride are potassium chloride and sodium chloride.

In case of continuous process of the photographic light-sensitive material, according to the present invention, the color developer can be continuously replenished. An amount of replenishment is preferably 1 to 10 ml/100 $cm^2$ of the photographic light-sensitive material of this invention. In addition, in order to prevent fogging, the developer preferably contains $3\times10^{-2}$ mol/liter of a water-soluble bromide. Preferably the color development is continuously performed using a color developer in which bromide ions are maintained at not more than $1.0\times10^{-2}$ mol/liter. Preferable water-soluble bromides are potassium bromide and sodium bromide.

It is-preferable to use a color developer which substantially does not contain iodide ions. The expression "substantially does not contain" means that an amount of iodide ions is 1.0 mg/liter or less.

According to the present invention, preferably, the color developer does not substantially contain sulfite as long as the developer is not oxidized and can be properly preserved. The content of an anhydrous sulfurous acid is preferably 4 g or less per liter, preferably 2 g or less, and most preferably 1 g or less, thereby improving coloring density of the colored dye.

A time of development by the color developer is 10 seconds to 3 minutes and 30 seconds, preferably 10 seconds to 2 minutes, and most preferably 20 seconds to one minute and 30 seconds.

3-4. Desilvering

The photographic light-sensitive material of the present invention is desilvered after color development is performed. Desilvering can be performed by one of the following methods (i) a method using a bleaching solution bath and fixing solution bath; (ii) a method using a bleaching solution bath and a bleach-fixing solution bath as described in Japanese patent application (OPI) No. 61-75,352; (iii) a method using a fixing solution bath and a bleach-fixing solution bath as described in Japanese patent application (OPI) No. 61-51,143; and (iv) a method using a single bleach-fixing solution bath. The photographic light-sensitive material is preferably processed by one or a plurality of bleach-fixing solution baths in order to shorten the process time.

Examples of the bleaching agent used in a bleach solution or a bleach-fixing solution are a ferric salt, persulfate, dichromate, bromate, red prussiate, and salt of aminopolycarboxylic acid ferric complex. A salt of aminopolycaroxylic acid ferric complex is preferably used in the photographic light-sensitive material of the present invention.

Preferable salts of aminopolycarboxylic acid ferric complex are listed below:

(1) salt of ethylenediaminetetraacetic acid ferric complex;
(2) salt of diethylenetriaminepentaacetic acid ferric complex;
(3) salt of cyclohexanediaminetetraacetic acid ferric complex;
(4) salt of iminodiacetic acid ferric complex;
(5) salt of methyliminodiacetic acid ferric complex;
(6) salt of 1,3-diaminopropanetetraacetic acid ferric complex;
(7) salt of glycoletherdiaminetetraacetic acid ferric complex.

These salts of aminopolycarboxylic acid ferric complex are used in the form of a sodium salt, potassium salt, or ammonium salt, and preferably in the form of an ammonium salt.

The content of the salt of aminopolycarboxylic acid ferric complex in bleaching solution and bleach-fixing solution is 0.05 to 1 mol/liter, preferably 0.1 to 1 mol/liter, and more preferably 0.1 to 0.5 mol/liter.

An accelerator for bleaching is used, if necessary, in a bleaching solution or a bleach-fixing solution. Specific examples of the useful accelerator for bleaching are: compounds containing mercapto or disulfide groups, as described in U.S. Pat. No. 3,893,858, Germany Patent Publication Nos. 1,290,812 and 2,059,988, Japanese patent application (OPI) Nos. 53-32,736, 53-57,831, 53-37,418, 53-65,732, 53-72,623, 53-95,630, 53-95,631, 53-104,232, 53-124,424, 53-141,623, and 53-28,426, and *Research Disclosure* No. 17,129 (July, 1978); thiazolidine derivatives described in Japanese patent application (OPI) No. 50-140,129; thiourea derivatives described in Japanese Patent Publication No. 45-8,506, Japanese patent application (OPI) Nos. 52-20,832 and 53-32,735, and U.S. Pat. No. 3,706,561; iodides described in Germany Patent Publication No. 1,127,715 and Japanese patent application (OPI) No. 58-16,235; polyethylene oxides described in Germany Patent Publication Nos. 966,410 and 2,748,430; polyamine compounds described in Japanese Patent Publication No. 45-8,836; compounds described in Japanese patent application (OPI) Nos. 49-42,434, 49-59,644, 53-94,927, 54-35,727, 55-26,506, and 58-163,940; and iodide and bromide ions. Of these bleaching accelerators, the compound having a mercapto or disulfido group is preferable due to an excellent acceleration effect. Particularly the compounds described in U.S. Pat. No. 3,893,858, Germany Patent Publication No. 1,290,812, and Japanese patent application (OPI) No. 53-95,630 are preferable.

The bleaching solution or the bleach-fixing solution can contain rehalogenation agents such as a bromides (e.g., potassium bromide, sodium bromide, and ammonium bromide), chlorides (e.g., potassium chloride, sodium chloride, and ammonium chloride), and iodides (e.g., ammonium iodide). Further, the bleaching solution or the bleach-fixing solution contain, if necessary, one or more of inorganic and organic acids alkali metal or ammonium salts thereof and, having pH buffering function, such as boric acid, borax, sodium methabrate, acetic acid, sodium acetate, sodium carbonate, potassium carbonate, phosphorous acid, phosphoric acid, sodium phosphate, citric acid, sodium citrate, and tartaric acid, or corrosion inhibitor such as ammonium nitrate and guanidine.

A fixing agent used in a bleach-fixing solution or fixing solution is a known fixing agent. Examples of the known fixing agent are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglicolic acid and 3,6-dithia-1,8-octanediole); and a thiourea. These fixing agents can be used singly or in a combination of at least two agents. The thiosulfate, particularly, ammonium thiosulfate, is preferably used in the present invention.

The content of the fixing agent per liter is preferably 0.3 to 2 mol and more preferably 0.8 to 1.5 mol.

The pH range of the bleach-fixing or fixing solution is preferably 3 to 10 and more preferably 5 to 9. When the pH of the solution is lower than the minimum value of the range, the desilvering effect can be improved. However, the solution is degraded and the cyan dye is converted into a leuco form. However, if the pH of the solution is higher than the maximum value of the range, desilvering is delayed and stain tends to occur. The pH range of the bleaching solution is 4 to 7, and preferably 4.5 to 6.5. If the pH is 4 or less, the cyan dye is converted into a leuco form. However, if the pH exceeds 7 or more, desilvering is delayed.

In order to adjust the pH of the solution, hydrochloric acid, sulfuric acid, nitric acid, acetic acid, bicarbonate, ammonia, potassium hydroxide, sodium hydroxide, sodium carbonate, potassium carbonate, or the like can be added to the solution.

The bleach-fixing solution and the fixing solution contain a phosphorous acid ion releasing compound as a preservatives such as a sulfite (e.g., sodium sulfite, potassium sulfite, and ammonium sulfite), a bisulfite (e.g., ammonium bisulfite, sodium bisulfite, and potassium bisulfite), and a methabisulfite (e.g., potassium methabisulfite, sodium methabisulfite, and ammonium methabisulfite). The content of these compounds is about 0.02 to 0.50 mol/liter, and more preferably 0.04 to 0.40 mol/liter as an amount of sulfite ion.

A typical preservative is a sulfite. However, ascorbic acid, a carbonyl bisulfite, acid adduct, or a carbonyl compound may be used.

A desilvering temperature is preferably a high temperature unless transient softening of a gelatin film and degradation of the process solution occur. The desilvering temperature normally falls within the range of 30° to 50° C. Desilvering time varies according to a desilvering method but is normally 4 minutes or less, and preferably 30 seconds to 3 minutes.

3-5. Washing and Stabilizing

After desilvering such as fixing or bleach-fixing, the photographic light-sensitive material of the present invention is normally subjected to washing and/or stabilizing.

An amount of water used in the washing process can be arbitrarily determined over a broad range in accordance with the properties (e.g., a property determined by use of a coupler and the like) of the photographic light-sensitive material, the use of the material, the temperature of the water, the number of water tanks (the number of stages), the replenishing scheme representing a counter or forward current, and other conditions. The relationship between the amount of water and the number of water tanks in a multi-stage countercurrent scheme can be obtained by a method described in "Journal of the Society of Motion Picture and Television Engineers, " No. 64, PP. 248–253 (May, 1955). In general, the number of water tanks in the counter-current scheme is preferably 2 to 6, and more preferably 2 to 4.

According to the multi-stage counter current scheme, the amount of water used for washing can be greatly decreased and can be 0.5 liter to 1 liter or less per square meters of photographic light-sensitive material. However, since washing water stays in the tanks for a long period of time, bacteria grow and floating products may be undesirably attached to the light-sensitive material. In order to solve the above problem in the process of the color photographic light-sensitive material of the present invention, a method for decreasing calcium and magnesium ions can be effectively utilized, as described in Japanese patent application No. 61-131,632. In addition, an isothiazolone compound and cyabendazole, as described in Japanese patent application (OPI) No. 57-8,542, a chlorine type germicide such as chlorinated sodium isocyanurate, described in Japanese patent application (OPI) No. 61-120,145, benzotriazole described in Japanese patent application No. 60-105,487, and germicides described in "Chemistry of Antibacterial and Antifungal Agents", Hiroshi Horiguchi, "Sterilization, Antibacterial, and Antifungal Techniques for Microorganisms" *Eiseigijutsu-Kai* ed., and "Dictionary of Bacteriacidal and Antifungal Agents", *Nippon Bokin Bokabi Gakkai* ed.

A surfactant serving as a wetting agent and a chelating agent represented by EDTA serving as a water-softener can be used in washing water.

The pH of the water for washing the photographic light-sensitive material of the present invention is 4 to 9 and preferably 5 to 8. The water temperature and the washing time can be vary according to the properties of the light-sensitive material and its application. Normally, the washing time falls within the range of 20 seconds to 10 minutes at a temperature of 15° to 45° C., and preferably 30 second to 5 minutes at a temperature of 25° to 40° C.

The photographic light-sensitive material can be treated with a stabilizing solution after it is washed with water or without being washed. The stabilizing solution contains a compound having an image stabilization function. Examples of such a compound are an aldehyde compound such as formaldehyde, a buffering agent for controlling the pH suitable for dye stabilization, and an ammonium compound. In addition, in order to prevent an increase in bacteria in the solution and provide an antifungal property to the photographic light-sensitive material, the above-mentioned various bacteriacides and antifungal agents are used.

Further, a surfactant, a fluorescent whitener, and a hardener can be used. If stabilization is performed without performing the wash process, all known methods such as those described in Japanese patent application (OPI) Nos. 57-8,543, 58-14,834, 59-184,343, 60-220,345, 60-238,832, 60-239,784, 60-239,749, 61-4,054, and 61-118,749 can be used.

Furthermore, 1-hydroxyethylidene-1,1-diphosphonic acid, a chelating agent such as ethylenediaminetetramethylenephosphonic acid, and a bismuth compound can be preferably used.

The solutions used in washing and/or stabilizing steps can be used again in the previous steps. An overflow portion of washing water obtained by reduced amount of water according to the multi-stage counter current flow can be supplied to the preceding bleach-fixing bath. The bleach-fixing bath is replenished with a condensed solution to reduce the amount of effluent.

3-6. Developing Method

When a large amount of photographic light-sensitive material is processed by the developing method of the present invention, the continuous process is preferred. If the photographic light-sensitive material is a disk film, the exposed material is placed in predetermined baths, and color development, bleaching-fixing, and wash/stabilization can be sequentially performed. However, if the light-sensitive material is a roll-like film for photographing or color paper, the light-sensitive material is sequentially fed to the process baths. The feed method may be a guide film transport, a roller transport, or a guide-rack transport.

In order to continuously process a long light-sensitive material, the process baths are replenished with corresponding process solutions, thereby replenishing for compensating the consumed components and preventing trouble associated with storage of containing eluted components of the light-sensitive material in the effluent. It is also preferable to correct changes in composition caused by oxidation of the developing solution when it is brought into contact with air. Countermeasures are provided to reduce the amount of solution to be replenished therefor the amount of effluent. In particular, utilization of the overflow portion of the wash/-stabilization solution has been described above. In addition, an overflow portion of the developing solution can be used in the bleach-fixing bath.

The total developing time from the start of development to the end of drying can be about 1 to 5 minutes, preferably 1 to 3.5 minutes, and most preferably 120 seconds or less.

EXAMPLES

Example 1 (Preparation of Emulsion)

A silver halide emulsion was prepared as follows.

| | |
|---|---|
| Solution 1: | |
| Bone Gelatin | 30 g |
| NaCl | 3.8 g |
| Water | 1,000 cc |
| $NH_4NO_3$ | 3 g |
| Solution 2: | |
| $AgNO_3$ | 15 g |
| $NH_4NO_3$ | 0.5 g |
| Water to make | 150 cc |
| Solution 3: | |
| NaCl | 6.3 g |
| Water to make | 150 cc |
| Solution 4: | |
| $AgNO_3$ | 135 g |
| $NH_4NO_3$ | 1 g |
| Water to make | 450 cc |
| Solution 5: | |
| NaCl | 51.7 g |
| Water to make | 450 cc |

Figure 1:
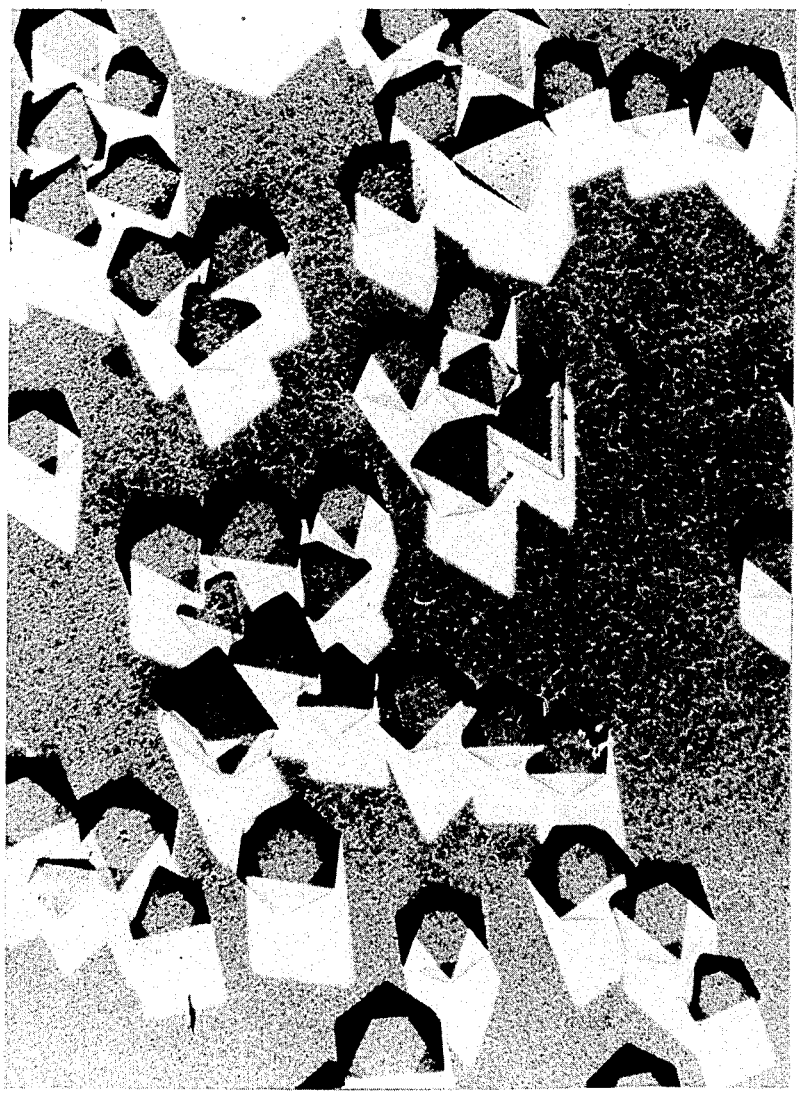
FIG. 1 is an electron microscopic photograph (magnification: 19,000) of octahedral silver halide crystal grains contained in emulsion 1 of Example 1.
Figure 2:
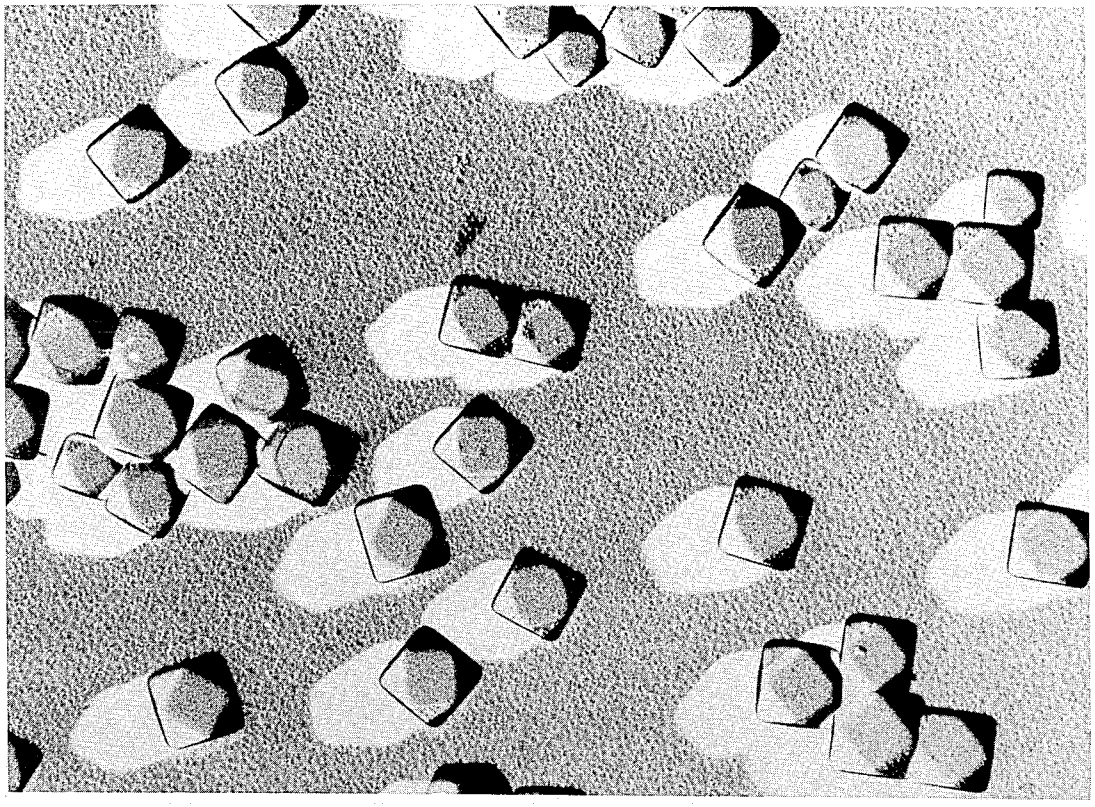
FIGS. 2 and 3 are electron microscopic photographs (magnification: 19,000) of dodecahedral crystal grains contained in emulsion 2 of Example 1 and cubic silver halide crystal grains contained in emulsion 3 thereof, respectively.
Figure 3:
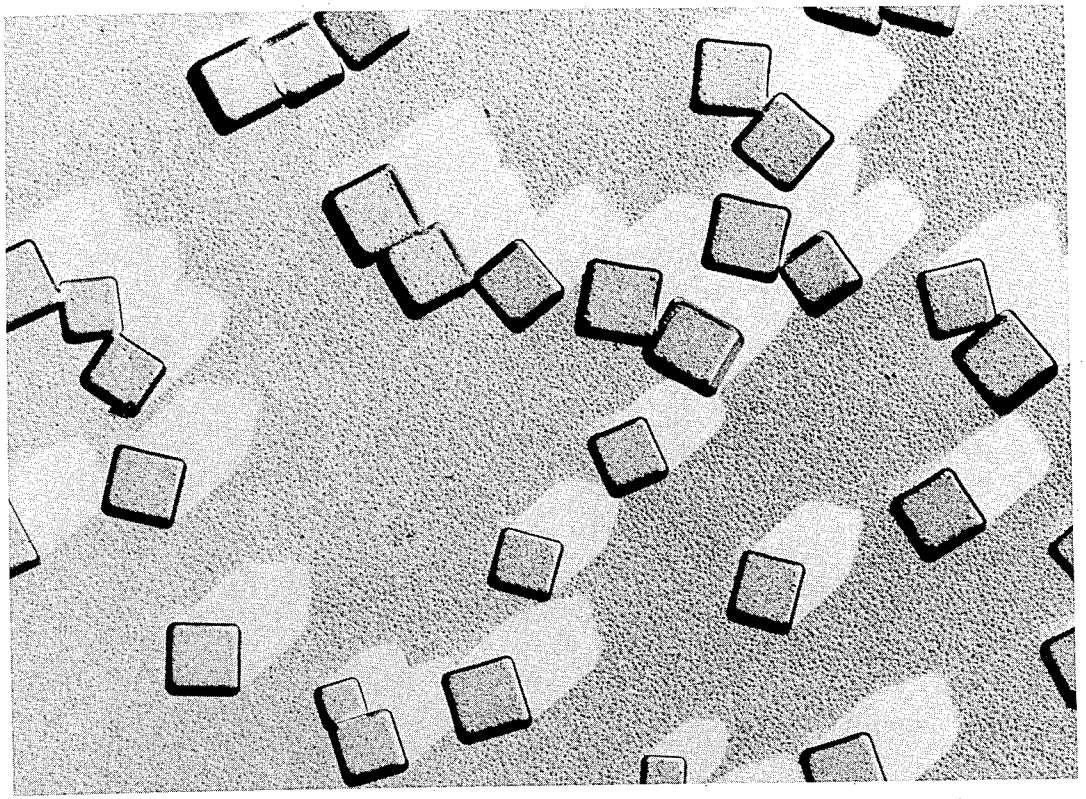

A 1N sulfuric acid solution was added to solution 1 maintained at 75° C. to adjust a pH of 5.0. Thereafter, solutions 2 and 3 were simultaneously added to solution, over 20 minutes, while solution 1 was strongly agitated. Then, solutions 4 and 5 were simultaneously added to the resultant solution, over 40 minutes, by an acceleration addition method so that a flow rate at a final stage was three times that at an initial stage. Addition of a 0.1N sulfuric acid solution was so controlled as to maintain the pH of the solution in a reaction chamber constant. In order to prepare emulsion 1, solution 6 obtained by dissolving 100 mg of compound (1) shown in Table 12 (to be presented later) in 200 cc of methanol was added at the same time at a constant rate when solutions 4 and 5 were added. From a timing one minute before completion of addition of solutions 4 and 5 to completion thereof, solution 7 obtained by dissolving 310 mg of a spectral sensitizing dye of compound (2) shown in Table 12 in 310 cc of a solution mixture of water and methanol was added at a constant rate. Emulsion 1 prepared as described above contained octahedral grains as shown in FIG. 1 having an average grain size of 0.82 μm. This emulsion has a strong light absorption peak at 464 nm and a weak light absorption peak at 437 nm. Following the same procedures as for emulsion 1, emulsion 2 was prepared. Note that compound (1) was added in an amount of 25 mg. Emulsion 2 contained tetradecahedral grains having the (111) crystal plane on 40% of the total surface area and having an average grain size of 0.83 μm as shown in FIG. 2. Following the same procedures as for emulsion 1, emulsion 3 was prepared. Note that solution 6 obtained by dissolving 100 mg of compound (1) in 200 cc of methanol was added at a constant rate over two minutes from a timing three minutes before completion of addition of solutions 4 and 5 to a timing one minute before completion thereof. Emulsion 3 contained cubic grains as shown in FIG. 3 having an average grain size of 0.83 μm.

310 mg of compound (2), a spectral sensitizing dye, was added in preparation of both emulsions 2 and 3 from a timing one minute before completion of addition of solutions 4 and 5 to completion thereof, thereby spectrally sensitizing the emulsions. Addition of the dye immediately before completion of addition of the solutions did no affect the form of grains.

Example 2

Grains were prepared following the same procedures as in Example 1 except that a temperature was reduced by 5° C. Then, the resultant grains were water-washed by a conventional flocculation method, and gelatin was added thereto after they were desalted. Thereafter, the resultant grains were adjusted a pH of 6.2 and a pAg of 7.0, at 40° C. Emulsion A was a mono-disperse emulsion containing octahedral grains having an average grain size (diameter corresponding to a sphere) of 0.70 μm and a grain size variation coefficient of 10%. Emulsion B contained tetradecahedral grains having the (111) crystal plane on 55% of the total surface areas, an average size of 0.72 μm and a variation coefficient of 9%. Emulsion C contained cubic grains having an average size of 0.73 μm and a variation coefficient of 9%. The above emulsions were subjected to chemical sensitization using diphenyltiourea and chloroauric acid. Chemical sensitizing agents used in this process are summarized in Table 2.

Additives as shown in Table 1 were added to the emulsion, and the resultant and a protective layer was applied to an undercoated triacetylcellulose film support, thereby preparing a light-sensitive material.

TABLE 1

| |
|---|
| (1) Emulsion Layer |
| Emulsion . . . Emulsions Shown in Table 2 |
| Yellow Coupler . . . Shown in Table 13 |
| Stabilizing agent: 1-(3-methylcarbamoylaminophenyl)-2-mercaptotetrazole |
| Coating Aid: Sodium Dodecylbenzene Sulfonate |
| Tricresylphosphate |
| Gelatin |
| (2) Protective Layer |
| 2,4-dichlorotriazine-6-hydroxy-s-triazine Sodium Salt |
| Gelatin |

These samples were subjected to sensitometry exposure, and the following color developing process was performed.

The densities of the developed samples were measured using a blue filter. The obtained photographic characteristics are summarized in Table 2.

The above development was performed at 38° C., in the following steps:

| | |
|---|---|
| 1. Color Developing | 1 min. 5 sec. |
| 2. Bleaching | 2 min. |
| 3. Washing | 2 min. |
| 4. Fixing | 2 min. |
| 5. Washing | 2 min. 15 sec. |
| 6. Stabilizing | 2 min. 15 sec. |

The compositions of the processing solutions used for the above steps were as follows:

| | |
|---|---|
| Color Developer: | |
| Dietylenetriamine Pentaacetic Acid | 1.0 g |
| 1-hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 3-methyl-4-amino-N-ethyl-N-β- | 4.5 g |

-continued

| | |
|---|---|
| hydroxyethylaniline Sulfate | |
| Water to make | 1.0 liter |
| pH | 10.05 |
| Bleaching Solution: | |
| Ammonium Bromide | 160.0 g |
| Aqueous Ammonia (28%) | 25.0 ml |
| Sodium Ethylenediamine tetraacetate | 130 g |
| Glacial Acetic Acid | 14 ml |
| Water to make | 1 liter |
| Fixing Solution: | |
| Sodium Tetrapoly Phosphate | 2.0 g |
| Sodium Sulfite | 4.0 g |
| Aqueous Ammonium Thiosulfate (70%) | 175.0 ml |
| Sodium Bisulfite | 4.6 g |
| Water to make | 1 liter |
| Stabilizing Solution: | |
| Formaldehyde | 8.0 ml |
| Water to make | 1 liter |

The results obtained by measuring the densities of the developed samples are summarized in Table 2 below. Sensitivity is represented by the reciprocal of an exposure amount required to give an optical density of fogging+0.2, and is indicated by a relative value if the sensitivity of Sample containing Emulsion A and $30\times10^{-6}$ mol/AgX of gold sensitizing agent is 100.

TABLE 2

| Emulsion | Sulfur Sensiting Agent mol/AgX | Gold Sensitizing Agent mol/AgX | fog | Photographic Sensitivity 1/100 sec Exposure | Photographic Sensitivity $10^{-4}$ sec Exposure |
|---|---|---|---|---|---|
| Emulsion A Octahedral | $4\times10^{-6}$ | $3\times10^{-6}$ | 0.25 | 40 | 32 |
| | | $10\times10^{-6}$ | 0.23 | 64 | 60 |
| | | $30\times10^{-6}$ | 0.11 | 100 | 95 |
| | | $100\times10^{-6}$ | 0.15 | 58 | 55 |
| Emulsion B Tetra-decahedral | $4\times10^{-6}$ | $3\times10^{-6}$ | 0.30 | 36 | 30 |
| | | $10\times10^{-6}$ | 0.25 | 50 | 45 |
| | | $30\times10^{-6}$ | 0.15 | 70 | 65 |
| Emulsion C Cubic | $4\times10^{-6}$ | $3\times10^{-6}$ | 0.40 | 10 | 5 |
| | | $10\times10^{-6}$ | 0.45 | 7 | 4 |
| | | $30\times10^{-6}$ | 0.48 | 6 | 4 |

As is apparent from Table 2, when a cubic emulsion is subjected to sulfur-plus-gold sensitization, fogging is increased and sensitivity is reduced. When the amount of a gold sensitizing agent is increased, the fogging is further increased and the sensitivity is further reduced. A high-intensity reciprocity failure is also increased. When grains having the (111) crystal plane such as tetradecahedral grains or octahedral grains are subjected to sulfur-plus-gold sensitization, fogging is rarely caused and sensitivity is increased. Especially when a large amount of a gold sensitizer is used, very preferable characteristics such as an increase in sensitivity and a reduction in fogging can be obtained. In addition, the high-intensity reciprocity failure is small.

Example 3

Following the same procedures as for emulsions A, B, and C, emulsions D, E, and F were prepared, except that a dye, compound (3) shown in Table H (to be presented later), was added in an amount of 280 mg in place of the spectral sensitizing dye, compound (2), and the temperature of precipitation was reduced to 68° C. Emulsion D contained octahedral grains, Emulsion E contained tetradecahedral grains, and Emulsion F contained cubic grains. The grain sizes of Emulsion D, E, and F were 0.66 μm, 0.65 μm, and 0.67 μm, respectively.

After desalting, the above emulsions were subjected to chemical sensitization using sodium thiosulfate and chloroauric acid to prepare light-sensitive materials, following the same procedures as in Example 2, except that a magenta coupler shown in Table 14 was used. These photosensitive materials were subjected to sensitometry exposure through a green filter and were subjected to a developing process following the same procedures as in Example 2. In terms of fogging, sensitivity, and a reciprocity failure, emulsions D and E gave more preferable photographic characteristics than those obtained by emulsion F. When an amount of the gold sensitizing agent was increased, preferable results could be obtained by emulsions D and E.

Example 4

Emulsions G, H, and I were prepared following the same procedures as for emulsions A, B, and C, except that a spectral sensitizing dye consisting of compound (5) shown in Table 15 (to be presented later) was added in an amount of 250 mg. Emulsion G contained octahedral grains, Emulsion H contained tetradecahedral grains, and Emulsion I contained cubic grains. The grain sizes of Emulsion G, H and I were 0.71 μm, 0.70 μm, and 0.71 μm, respectively. After desalting, the above emulsions were subjected to chemical sensitization using chloroauric acid and sodium thiocyanate to prepare light-sensitive materials, following the same procedures as in Example 2, except that a cyan coupler shown in Table 15 was used. These light-sensitive materials were subjected to sensitometry exposure through a red filter and developed following the same procedures as in Example 2.

Especially when an amount of the gold sensitizer was increased, emulsions G and H gave preferable results in terms of sensitivity, fogging, and a reciprocity failure.

Example 5

A sample as a multilayer color light-sensitive material having layers of the following compositions on an undercoated triacetyl cellulose film support was prepared.

COMPOSITIONS OF LIGHT-SENSITIVE LAYERS

The contents of halide silver and colloid silver are measured in units of g/m² of silver, those of couplers, additives, and gelatin are measured in units of g/m², and those of sensitizing dyes are measured in mols with respect to 1 mol of the silver halide in a corresponding layer.

| | |
|---|---|
| Layer 1: Antihalation Layer: | |
| Black Colloid Silver | 0.2 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersion Oil Oil-1 | 0.01 |
| Dispersion Oil Oil-2 | 0.01 |
| Layer 2: Interlayer: | |
| Gelatin | 1.0 |
| Colored Coupler C-2 | 0.02 |
| Dispersion Oil Oil-1 | 0.1 |
| Layer 3: 1st Red-sensitive Emulsion Layer: | |
| Emulsion (1) | Shown in Table 3 silver 1.0 |
| Gelatin | 1.0 |
| Coupler C-3 | 0.48 |
| Coupler C-4 | 0.56 |
| Coupler C-8 | 0.08 |

-continued

| | |
|---|---|
| Coupler C-2 | 0.08 |
| Coupler C-5 | 0.04 |
| Dispersion Oil Oil-1 | .. 0.30 |
| Dispersion Oil Oil-3 | 0.04 |
| Layer 4: 2nd Red-sensitive Emulsion Layer: | |
| Emulsion (2) | Shown in Table 3 silver 1.0 |
| Gelatin | 1.0 |
| Coupler C-6 | 0.05 |
| Coupler C-7 | 0.1 |
| Dispersion Oil Oil-1 | 0.01 |
| Dispersion Oil Oil-2 | 0.05 |
| Layer 5: Interlayer: | |
| | Shown in Table 3 |
| Gelatin | 1.0 |
| Compound Cpd-A | 0.03 |
| Dispersion Oil Oil-1 | 0.05 |
| Layer 6: 1st Green-sensitive Emulsion Layer: | |
| Emulsion (3) | Shown in Table 3 silver 0.8 |
| Gelatin | 0.8 |
| Coupler C-9 | 0.30 |
| Coupler C-12 | 0.10 |
| Coupler C-1 | 0.06 |
| Coupler C-10 | 0.03 |
| Coupler C-5 | 0.02 |
| Layer 7: 2nd Green-sensitive Emulsion Layer: | |
| Emulsion (4) | Shown in Table 3 silver 0.85 |
| Gelatin | 1.0 |
| Coupler C-11 | 0.01 |
| Coupler C-12 | 0.04 |
| Coupler C-13 | 0.20 |
| Coupler C-1 | 0.02 |
| Coupler C-15 | 0.02 |
| Dispersion Oil Oil-1 | 0.20 |
| Dispersion Oil Oil-2 | 0.05 |
| Layer 8: Yellow Filter Layer: | |
| Gelatin | 1.2 |
| Yellow Colloid Silver | 0.08 |
| Compound Cpd-B | 0.1 |
| Dispersion Oil Oil-1 | 0.3 |
| Layer 9: 1st Blue-sensitive Emulsion Layer: | |
| Emulsion (5) | Shown in Table 3 silver 0.4 |
| Gelatin | 1.0 |
| Coupler C-14 | 0.9 |
| Coupler C-5 | 0.07 |
| Dispersion Oil Oil-1 | 0.2 |
| Layer 10: 2nd Blue-sensitive Emulsion Layer: | |
| Emulsion (6) | Shown in Table 3 silver 0.5 |
| Gelatin | 0.6 |
| Coupler C-14 | 0.25 |
| Dispersion Oil Oil-1 | 0.07 |
| Layer 11: 1st Protective Layer: | |
| Gelatin | 0.8 |
| Ultraviolet Absorbent UV-1 | 0.1 |
| Dispersion Oil Oil-1 | 0.01 |
| Dispersion Oil Oil-2 | 0.01 |
| Layer 12: 2nd Protective Layer: | |
| Gelatin | 0.45 |
| Poly methyl methacrylate Particles (diameter: 1.5 μ) | 0.2 |
| Film Hardening Agent H-1 | 0.4 |
| Formaldehyde Scavenger S-1 | 0.5 |
| Formaldehyde Scavenger S-2 | 0.5 |

A surface active agent was added to each of the above layers as a coating additive, in addition to the components described above.

The chemical formulas or the names of the compounds used in the present invention are summarized in Table 16 (to be presented later).

The emulsions used to prepare the samples were prepared as follows:

TABLE 3

Emulsion (1): In preparation of Emulsion G, the temperature of precipitation was 53° C., dyes, Compounds (5), (6), and (7), were added, and after desalting, the emulsion was optimally subjected to chemical sensitization using sodium thiosulfate, chloroauric acid, and potassium thiosulfate. (average grain size: 0.40μ, variation coefficient: 12%)

Emulsion (2): In preparation of Emulsion (1), the temperature of precipitation was 73° C. (average grain size: 0.71μ, variation coefficient: 11%)

Emulsion (3): In preparation of Emulsion D, the temperature of precipitation was 53° C., dyes, Compounds (3) and (8), were added, and after desalting, the emulsion was optimally subjected to chemical sensitization using sodium thiosulfate and chloroauric acid. (average grain size: 0.38μ, variation coefficient: 10%)

Emulsion (4): In preparation of Emulsion (3), the temperature of precipitation was 73° C. (average grain size: 0.66μ, variation coefficient 10%)

Emulsion (5): In preparation of Emulsion (1), the temperature of precipitation was 55° C., a dye, Compound (2), was added, and after desalting, the emulsion was optimally subjected to chemical sensitization using diphenylthiourea and chloroauric acid. (average grain size: 0.43μ, variation coefficient: 14%)

Emulsion (6): In preparation of Emulsion (1), the temperature of precipitation was 73° C., a dye, Compound (2) was added, and after desalting the emulsion was optimally subjected to chemical sensitization using chloroauric acid and diphenylthiourea. (average grain size: 0.70μ, variation coefficient: 10%)

The samples prepared as described above were exposed in accordance with the JIS (Japan Industrial Standard) procedure and then subjected to a process shown in Table 4.

The processed amount of each sample was 50 m/day, and each sample was processed for 16 days while replenishing processing solutions. After the processing solutions reached steady compositions in a continuous 15 process, the process was performed.

TABLE 4

| Step | Processing Time | Processing Temperature | Amount of Replenisher* | Tank Capacity |
|---|---|---|---|---|
| Color Developing | 1 min | 38° C. | 10 ml | 4 liter |
| Bleach-fixing | 1 min | 38° C. | 20 ml | 4 liter |
| Washing (1) | 15 sec | 38° C. | Counter-current Replenishment From (2) To (1) | 2 liter |
| Washing (2) | 15 sec | 38° C. | 10 ml | 2 liter |
| Drying | 30 sec | 65° C. | | |

*Amount per 1 m of a sample having a 35-mm width.

The compositions of the processing solutions (mother solutions and replenishing solutions) are summarized below.

| Color Developing Solution: (g) | Mother Solution | Replenishing Solution |
|---|---|---|

-continued

| | | |
|---|---|---|
| Water | 900 ml | 900 ml |
| Potassium Chloride | 1.0 | 1.0 |
| Potassium Carbonate | 34.6 | 38.0 |
| Sodium Bicarbonate | 1.8 | 2.0 |
| Ethhylenediamine-N,N,N,N-tetramethylenephosphonic Acid | 1.0 | 1.2 |
| Triethylenediamine(1,4-diazabicyclo [2,2] octane) | 5.3 | 6.0 |
| Diethylhydroxylamine | 4.2 | 5.5 |
| 3-methyl-4-amino-N-ethyl-N-β-hydroxyethylianiline Sulfate | 4.6 | 7.5 |
| Potassium Hydroxide to obtain | pH 10.05 | pH 10.15 |
| Water to make | 1.0 liter | 1.0 liter |

| Bleach-fixing Solution: | Common for Mother Solution and Replenishing Solution (g) |
|---|---|
| Ethylenediaminetetracetic Acid Ferric Ammonium Dihydrate | 90.0 |
| Ethylenediaminetetracetic Acid Disodium Salt | 10.0 |
| Sodium Sulfate | 12.0 |
| Aqueous Ammonium Thiosulfate Solution (70%) | 260.0 ml |
| Acetic Acid (98%) | 5.0 ml |
| Accerator for Bleaching | 0.01 mol |

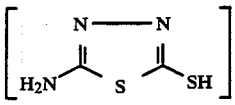

| | | |
|---|---|---|
| Water to make | 1.0 liter | 1.0 liter |
| pH | | 6.0 |

Washing solution: Common for Mother Solution and Replenishing Solution

Ion-Exchanged Water: 1 liter (The ion-exchanged water is obtained by supplying water into a mixed-bed column in which H-type strongly acidic cation exchange resin DIAION SK-1B (tradename), available from Mitsubishi Chemical Industries, Ltd., and OH-type strongly basic anion exchange resin DIAION SA-10A (tradename), available from Mitsubishi Chemical Industries, Ltd., are charged at a volume ratio of 1:1.5, so that calcium and magnesium in the water are reduced to 3 mg/liter or less)

Sodium Dichloro isocyanurate: 20 mg

Sodium Sulfate: 150 mg

Polyoxyethylene-p-mono-nonyl Phenyl Ether (mean polymerization degree: 10): 300 mg pH: 6.5 to 7.5

After the above process, a sample similar to those subjected to the continuous process was exposed on the basis of the JIS and then processed.

The ISO sensitivity of the processed film was calculated on the basis of the JIS. As a result, it was confirmed that the sample had a sensitivity equivalent to ISO 50.

Example 6

The process was performed following the same procedures as in Example 5, except that the compositions of the processing solutions are changed as follows. As a result, it was confirmed that the present samples had a sensitivity corresponding to ISO 50, similar to the result obtained in Example 5.

TABLE 5

| Step | Processing Time | Processing Temperature | Amount of Replenishing Solution* | Tank Capacity |
|---|---|---|---|---|
| Color Developing | 30 sec | 42° C. | 20 ml | 4 liter |
| Bleach-fixing | 30 sec | 42° C. | 20 ml | 4 liter |
| Washing (1) | 10 sec | 42° C. | Counter-current Replenishment From (2) To (1) | 2 liter |
| Washing (2) | 10 sec | 42° C. | 20 ml | 2 liter |
| Drying | 30 sec | 65° C. | | |

*Amount per 1 m of a sample having a 35-mm width.

The compositions of the processing solution are summarized below.

| | Mother Solution | Replenishing Solution |
|---|---|---|
| Color Developer: (g) | | |
| Water | 900 ml | 900 ml |
| Potassium Chloride | 2.0 | 2.0 |
| Potassium Carbonate | 34.6 | 38.0 |
| Sodium Bicarbonate | 1.0 | 1.5 |
| Ethylenediamine-N,N,N,N-tetramethylenephosphonic Acid | 2.0 | 2.4 |
| Triethylenediamine(1,4-diazabicyclo [2,2,2] octane) | 5.3 | 6.0 |
| Diethylhydroxylamine | 4.2 | 5.5 |
| 3-methyl-4-amino-N-ethyl-N-β-hydroxyethylaniline Sulfate | 6.0 | 8.0 |
| Potassium Hydroxide to obtain | pH 10.2 | pH 10.3 |
| Water to make | 1 liter | 1 liter |
| Bleach-fixing Solution: | | |
| Water | 600 ml | 600 ml |
| Ethylenediaminetetracetic Acid Ferric Ammonium Dihydrate | 90.0 | 100.0 |
| Ethylenediaminetetracetic Acid Disodium Salt | 10.0 | 10.0 |
| Ammonium Sulfite | 10.0 | 12.0 |
| Aqueous Ammonium Thiosulfate Solution (70%) | 26.0 ml | 270.0 ml |
| Accerator for Bleaching | 0.01 mol | 0.015 mol |

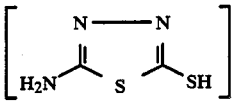

| | | |
|---|---|---|
| Acetic Acid to obtain | pH 5.5 | pH 5.0 |
| Water to make | 1.0 liter | 1.0 liter |

Washing Water: Common for Mother Solution and Replenishing Solution

Ion-Exchanged Water: 1 liter (The ion-exchanged water is obtained by supplying water into a mixed-bed column in which H-type strongly acidic cation exchange resin DIAION SK-1B (tradename) available from Mitsubishi Chemical Industries Ltd. and OH-type strongly basic anion exchange resin DIAION SA-10A (tradename) available from Mitsubishi Chemical Industries Ltd. are charged at a volume ratio of 1:1.5 so that calcium and magnesium in the water are reduced to 3 mg/liter or less)

Sodium Dichlorinated isocyanurate: 20 mg

Sodium Sulfate: 150 mg

Polyoxyethylene-p-mono-nonyl Phenyl Ether (mean polymerization degree: 10): 300 mg pH: 6.5 to 7.5

TABLE 6

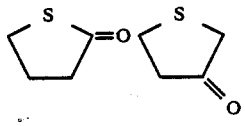

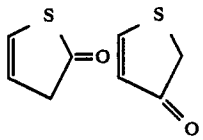

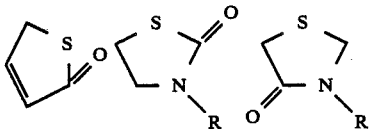

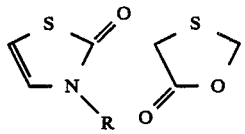

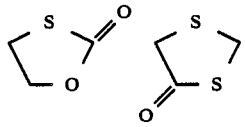

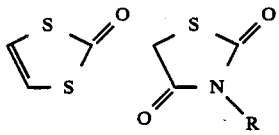

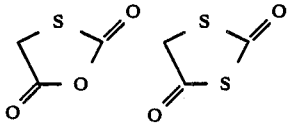

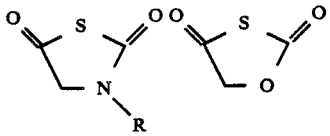

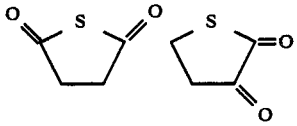

TABLE 6-continued

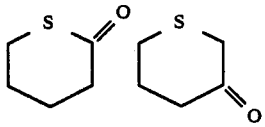

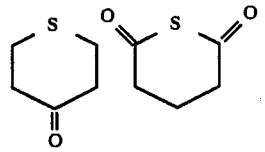

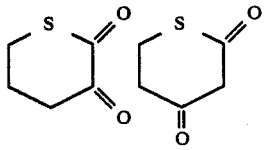

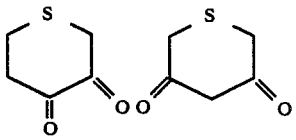

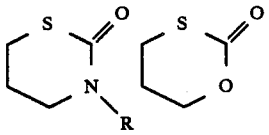

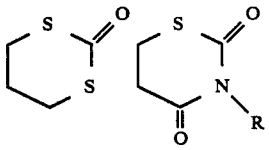

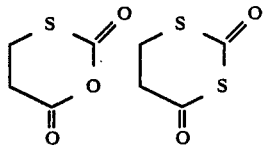

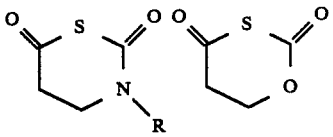

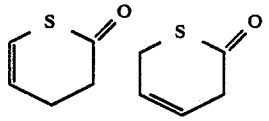

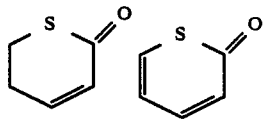

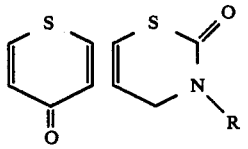

TABLE 6-continued
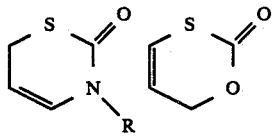
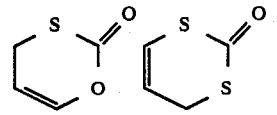
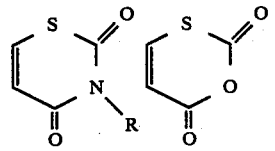
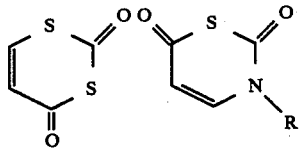
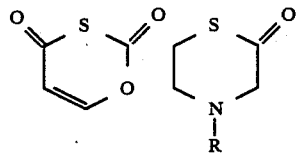
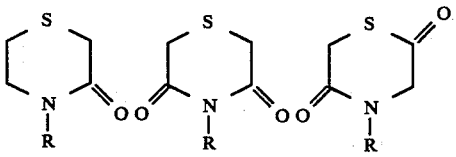
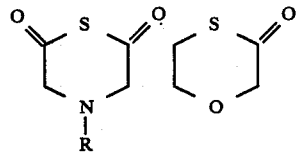
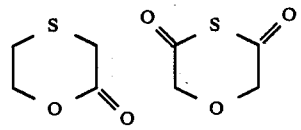
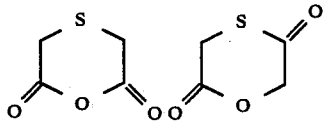
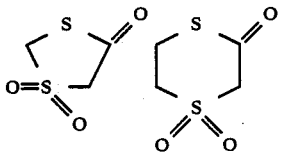
TABLE 6-continued
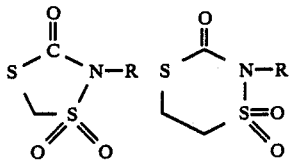
TABLE 7
I-1
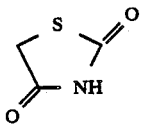
I-2
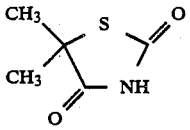
I-3
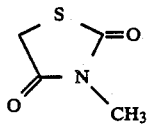
I-4
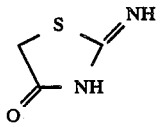
I-5
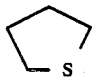
I-6
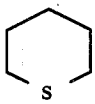
I-7
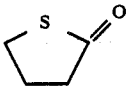
I-8
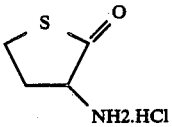
I-9
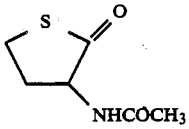
I-10
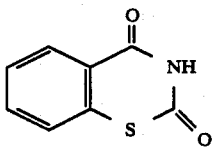

TABLE 7-continued
I-11
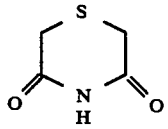
I-12
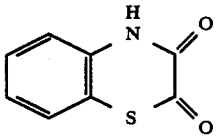
I-13
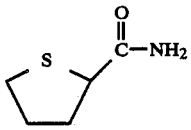
I-14
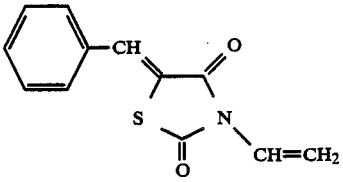
I-15
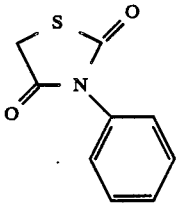
I-16
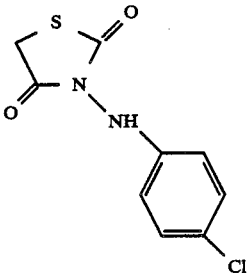
I-17
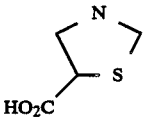
TABLE 8
II-1
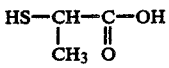
II-2
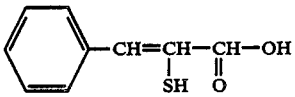
II-3
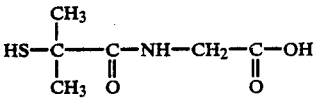
TABLE 8-continued
II-4
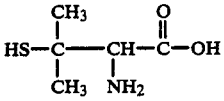
II-5
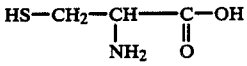
II-6
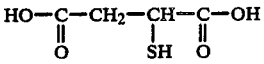
II-7
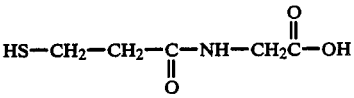
II-8
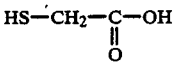
II-9
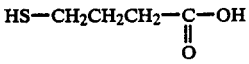
II-10
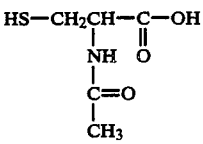
II-11
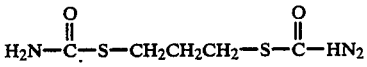
II-12
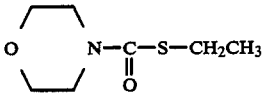
II-13
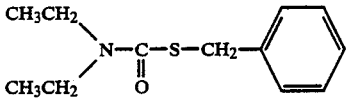
II-14
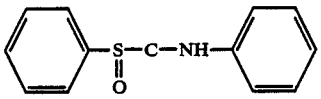
II-15
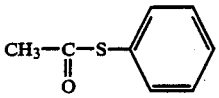
II-16
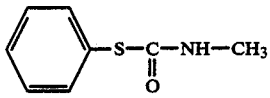
II-17
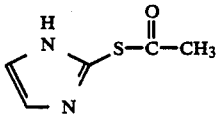
II-18
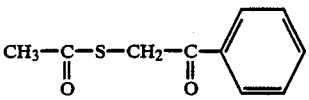

TABLE 8-continued
II-19
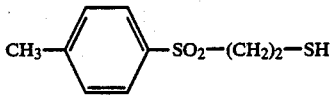
II-20
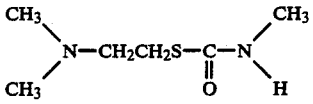
II-21
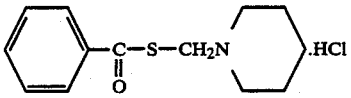
TABLE 8-continued
II-22
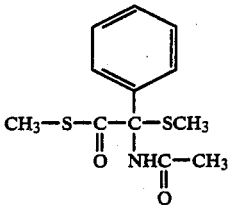
II-23
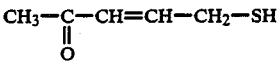
II-24
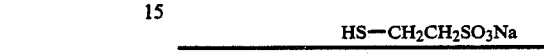
TABLE 9
III-1
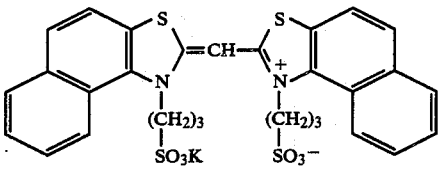
III-2
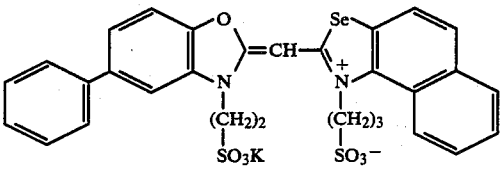
III-3
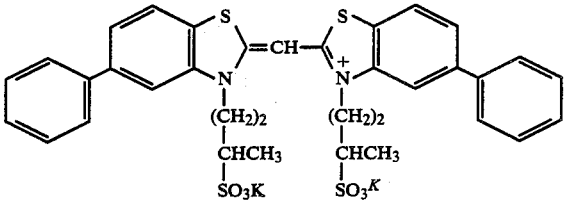
III-4
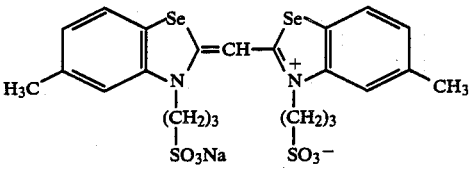
III-5
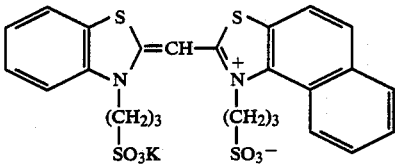
III-6
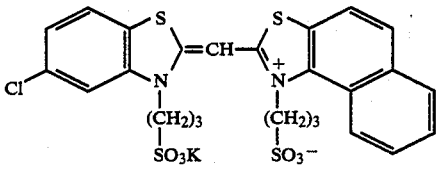

TABLE 9-continued
III-7
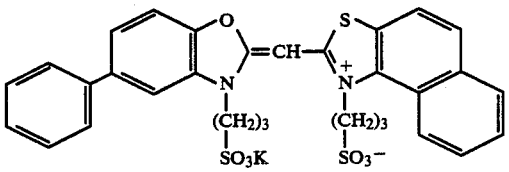
III-8
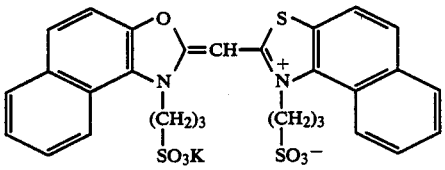
III-9
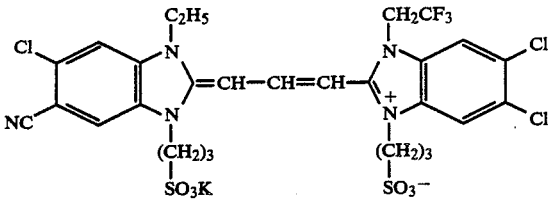
III-10
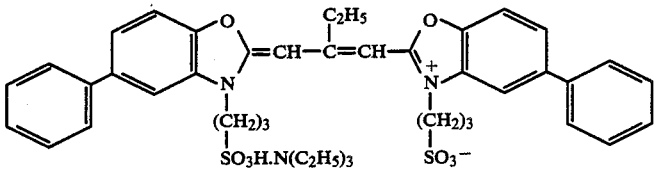
III-11
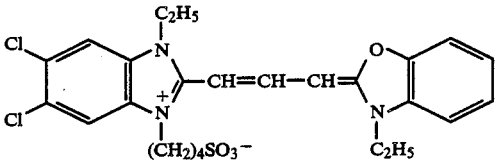
III-12
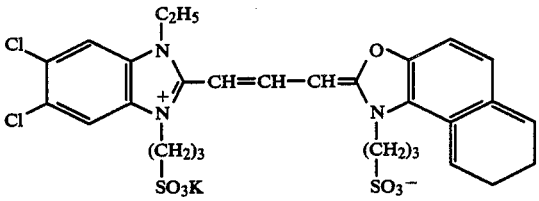
III-13
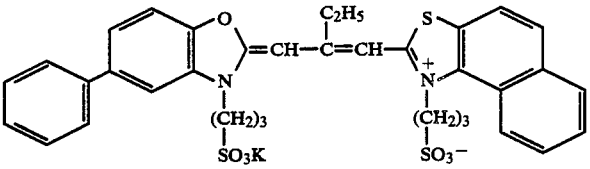
III-14
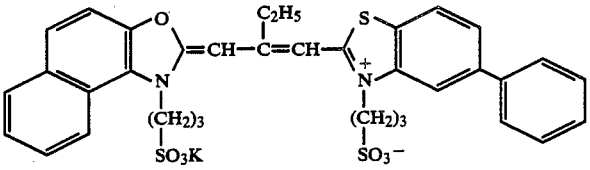

TABLE 9-continued
III-15
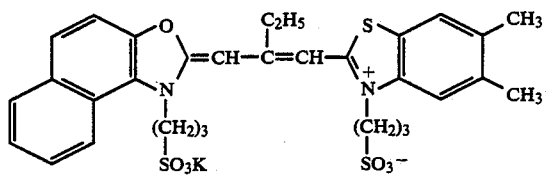
III-16
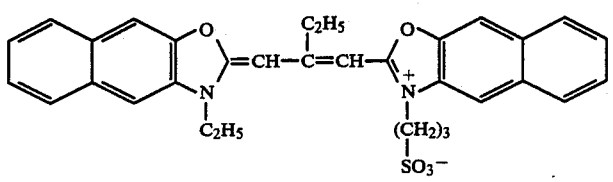
III-17
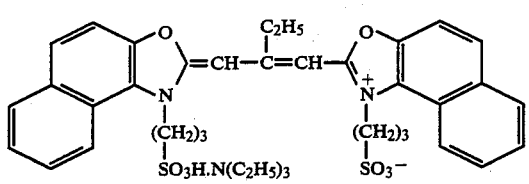
III-18
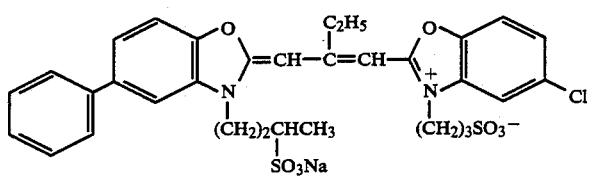
III-19
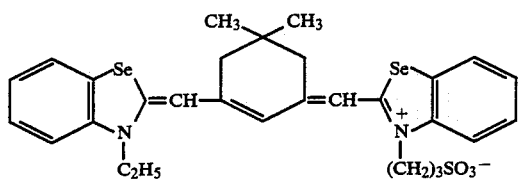
III-20
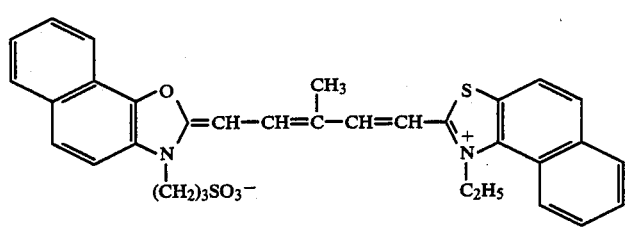
III-21
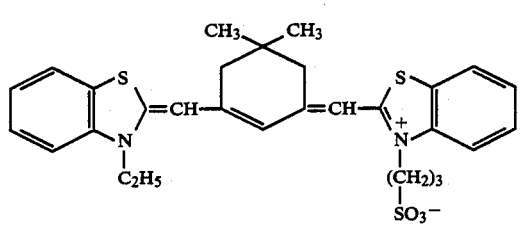
III-22
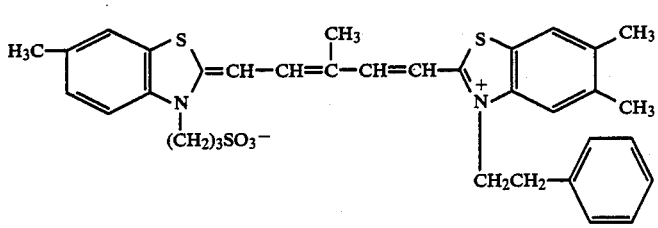

TABLE 9-continued
III-23
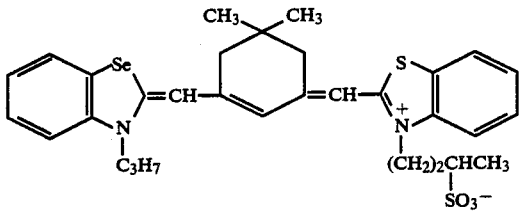
III-24
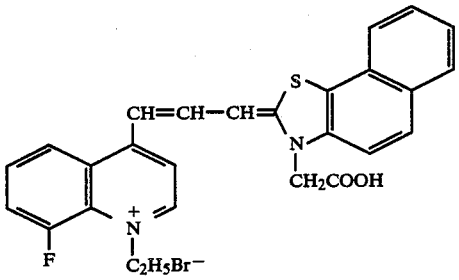
III-25
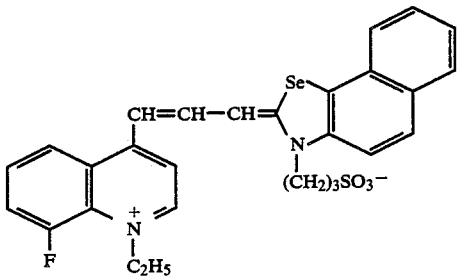
III-26
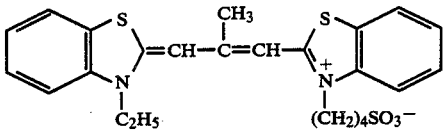
III-27
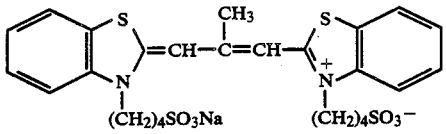
III-28
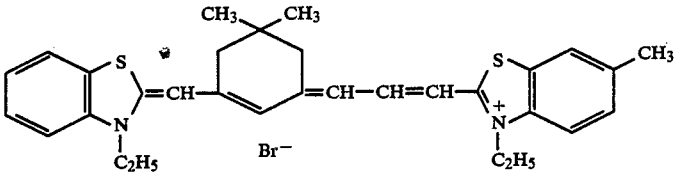
III-29
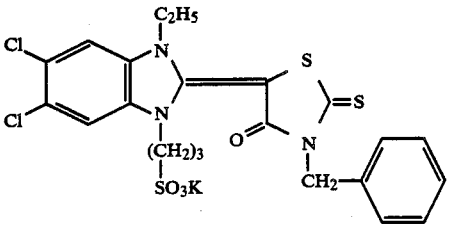

TABLE 9-continued
III-30
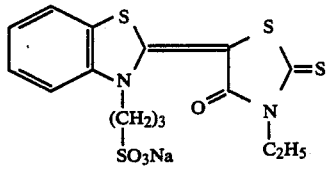
III-31
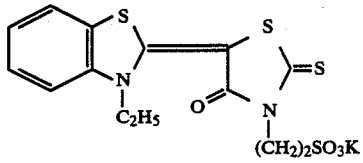
III-32
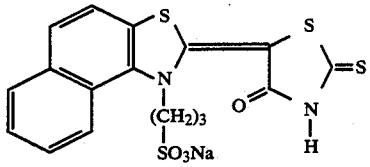
III-33
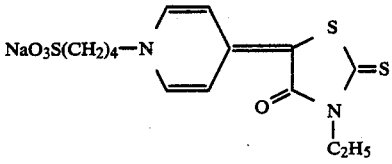
III-34
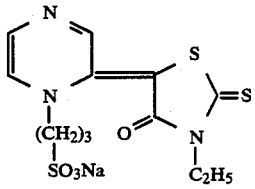
III-35
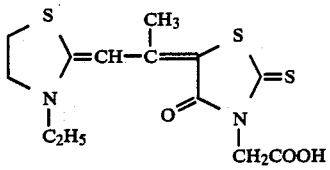
III-36
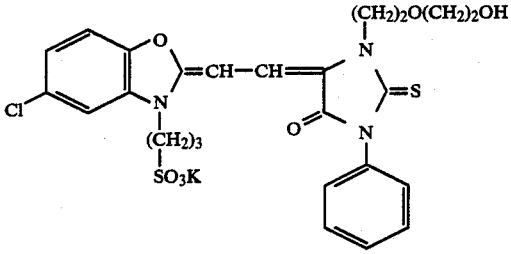
III-37
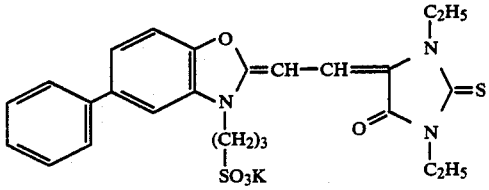

TABLE 9-continued
III-38
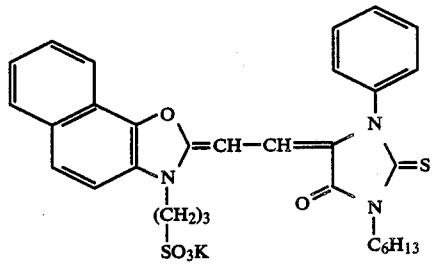
III-39
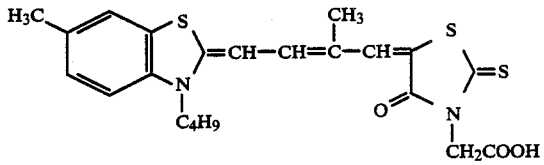
III-40
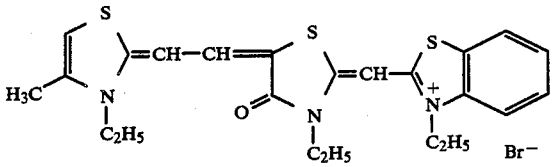
III-41
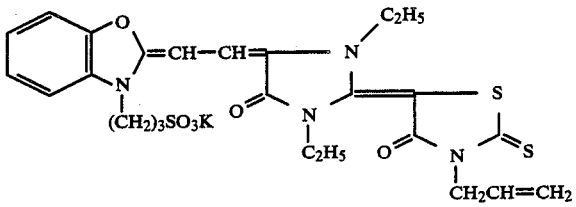
TABLE 10
IV-1
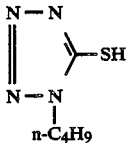
IV-2
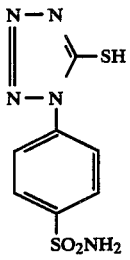
IV-3
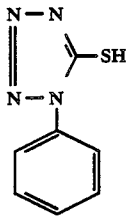
TABLE 10-continued
IV-4
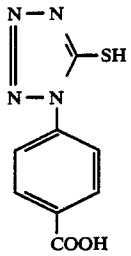
IV-5
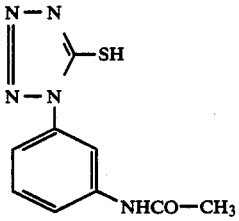
IV-6
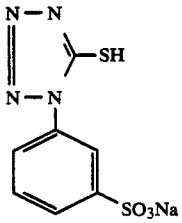

TABLE 10-continued
IV-7
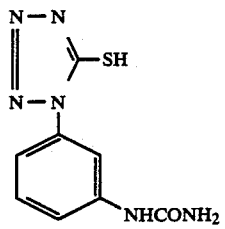
IV-8
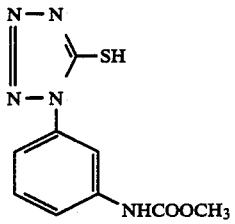
IV-9
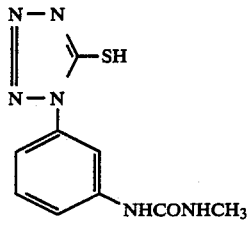
IV-10
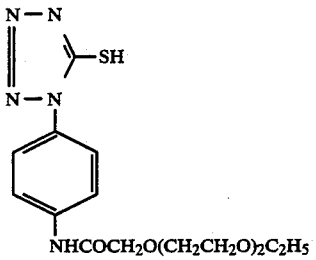
IV-11
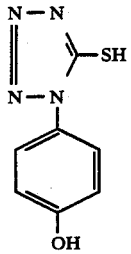
IV-12
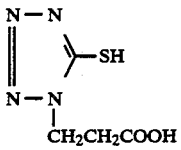
IV-13
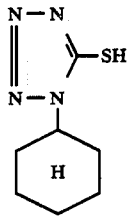
TABLE 10-continued
IV-14
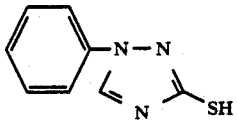
IV-15
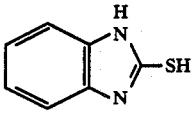
IV-16
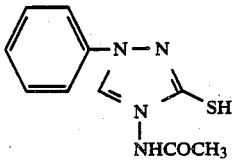
IV-17
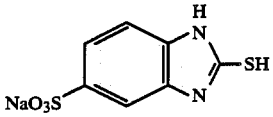
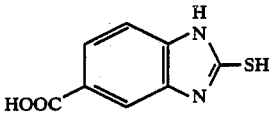
IV-18
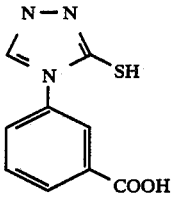
IV-19
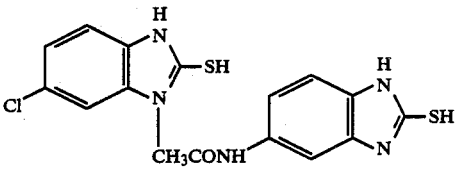
IV-20
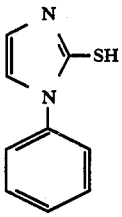
IV-21
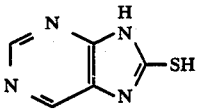

TABLE 10-continued
IV-22
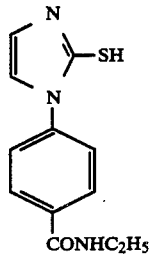
IV-23
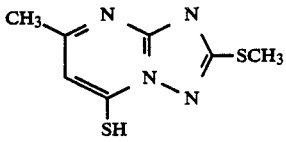
IV-24
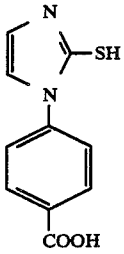
IV-25
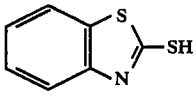
IV-26
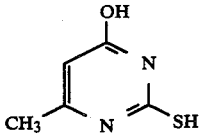
IV-27
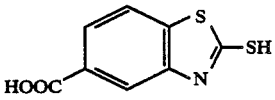
IV-28
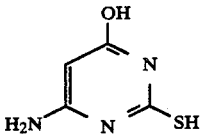
IV-29
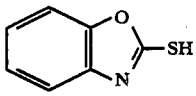
IV-30
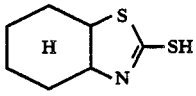
IV-31
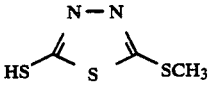
TABLE 10-continued
IV-32
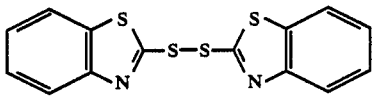
IV-33
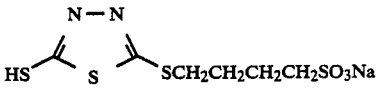
IV-34
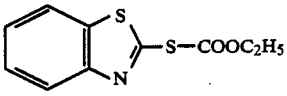
IV-35
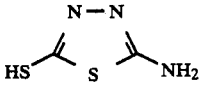
IV-36
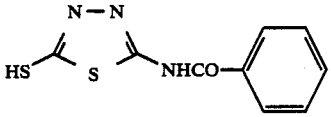
IV-37
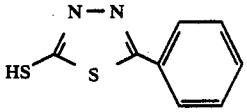
IV-38
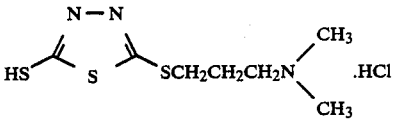
IV-39
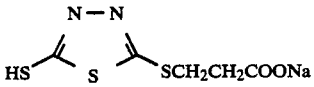
IV-40
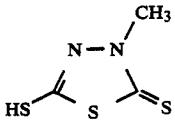
TABLE 11
V-1
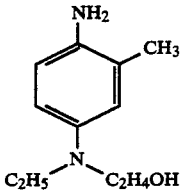
V-2
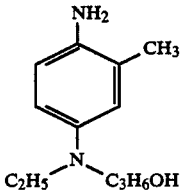

TABLE 11-continued
V-3
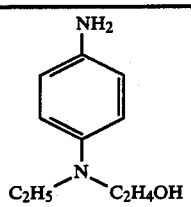
V-4
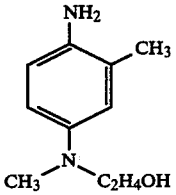
V-5
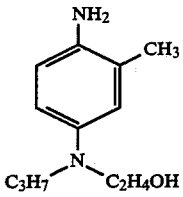
V-6
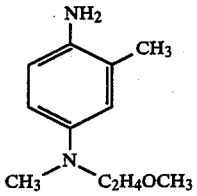
V-7
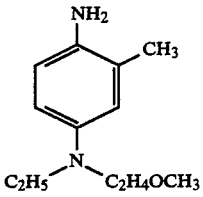
V-8
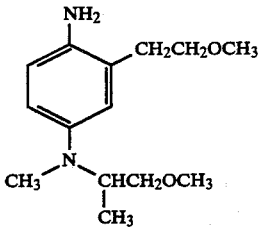
TABLE 11-continued
V-9
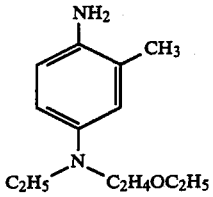
V-10
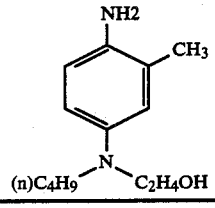
TABLE 12
Compounds used in Example 1
Compound 1 (II-22)
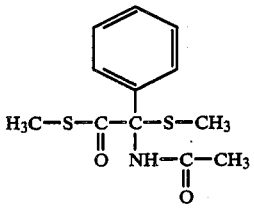
Compound 2
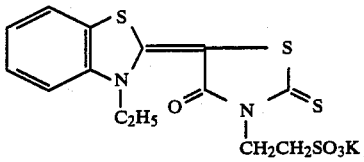
TABLE 13
Compound used in Example 2
Yellow Coupler
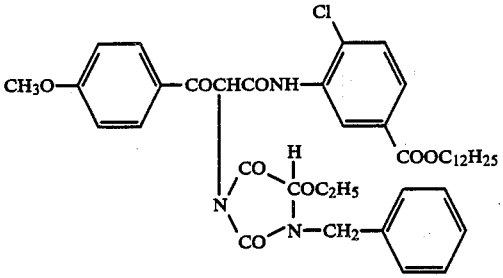
TABLE 14
Compounds used in Example 3
Compound 3
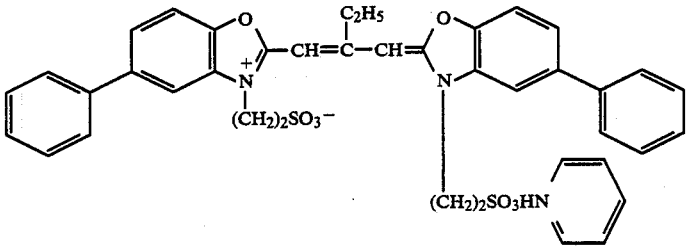

TABLE 14-continued
| Compounds used in Example 3 | |
|---|---|
| 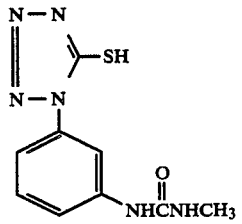 | Compound 4 |
| 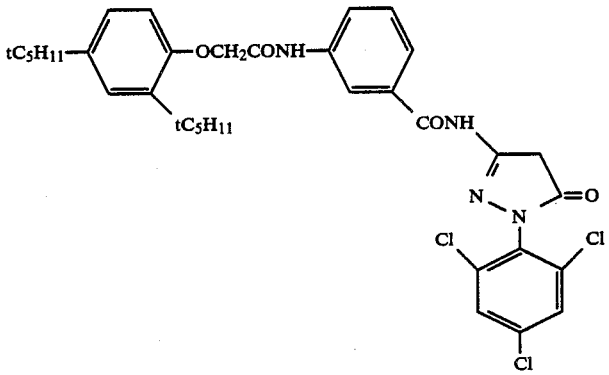 | Magenta coupler |
TABLE 15
| Compounds used in Example 4 | |
|---|---|
| 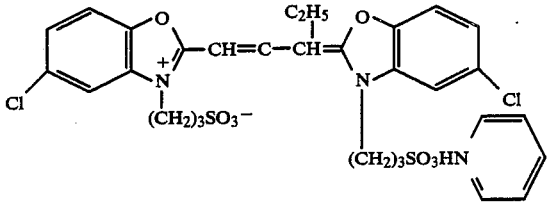 | Compound 5 |
| 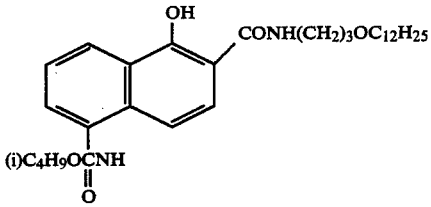 | Cyan coupler |
TABLE 16
| Compounds used in Example 5 | |
|---|---|
| 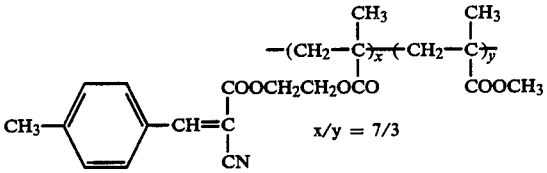 x/y = 7/3 | UV-1 |
| 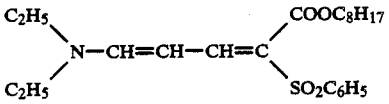 | UV-2 |
| tricresyl phosphate | Oil-1 |
| dibutyl phtalate | Oil-2 |
| bis(2-ethylhexyl)phtalate | Oil-3 |

TABLE 16-continued
Compounds used in Example 5
C-1
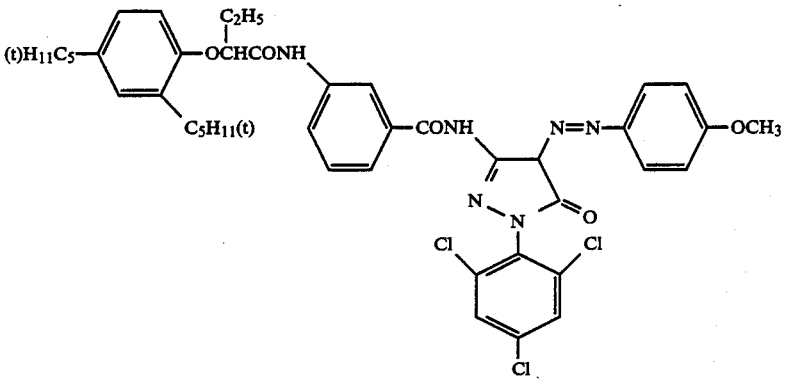
C-2
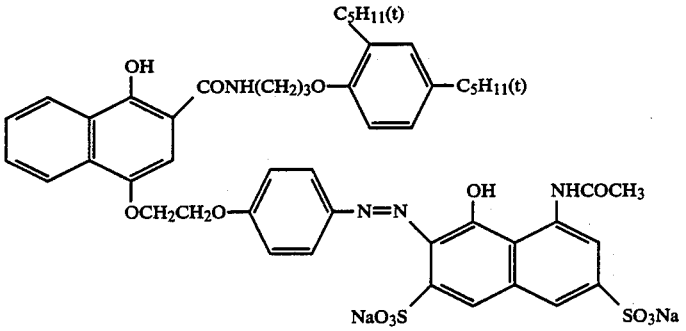
C-3
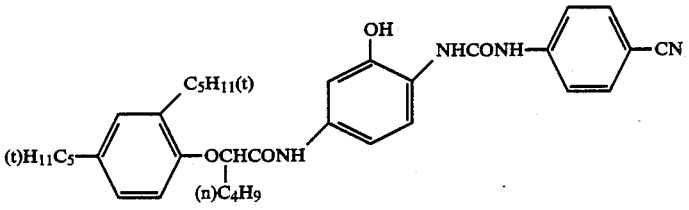
C-4
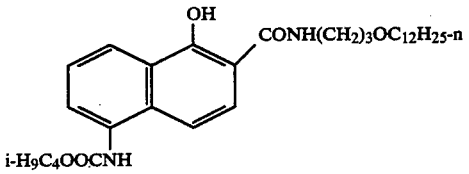
C-5
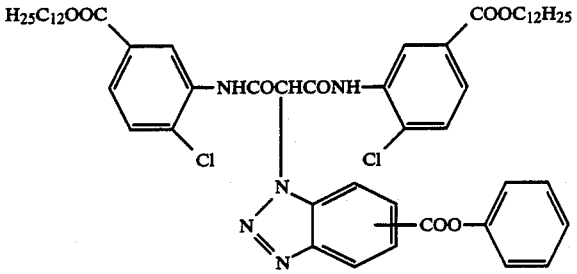

TABLE 16-continued
Compounds used in Example 5
C-15
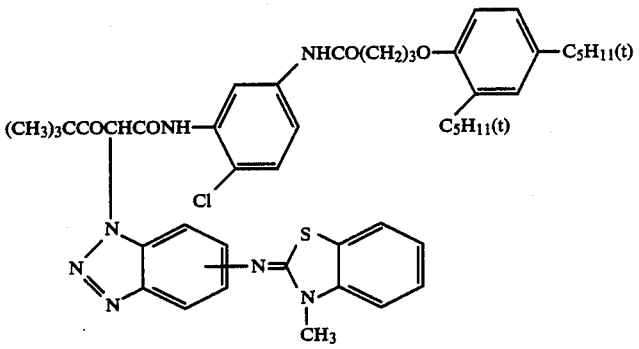
C-6
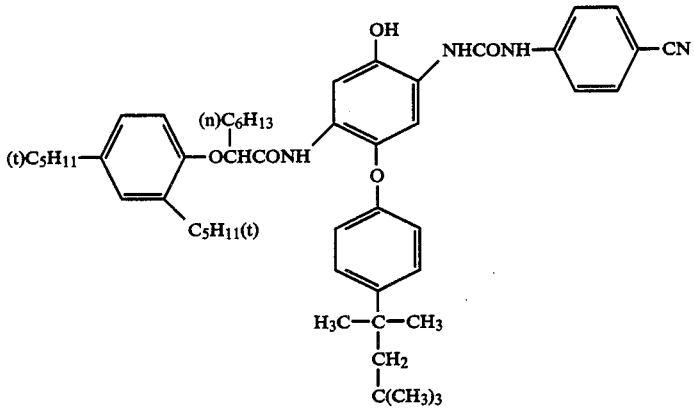
C-7
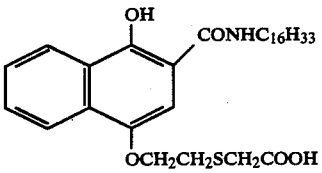
C-8
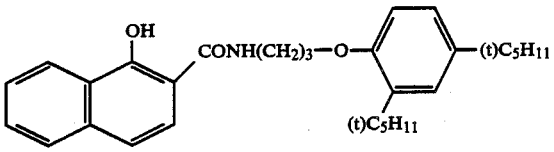

TABLE 16-continued
Compounds used in Example 5
C-9
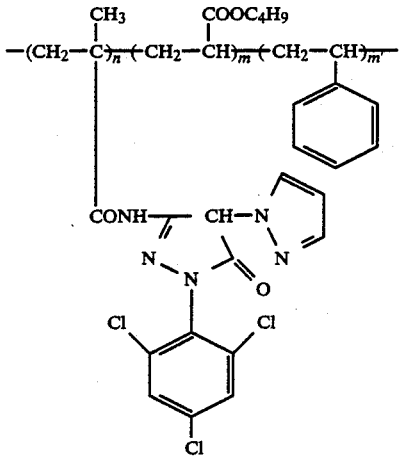
n = 50
m = 25 (weight ratio)
m' = 25
mol. wt. about 20,000
C-12
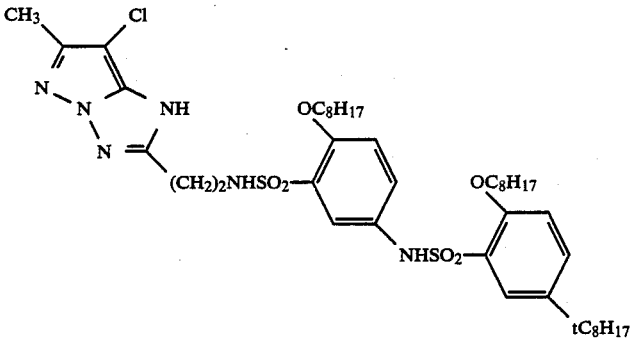
C-10
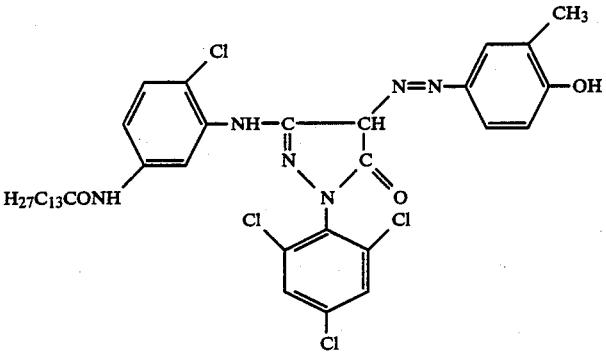
C-11
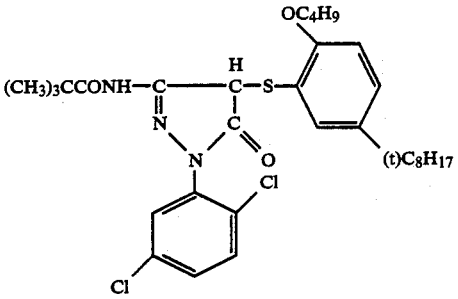

TABLE 16-continued
Compounds used in Example 5
C-13
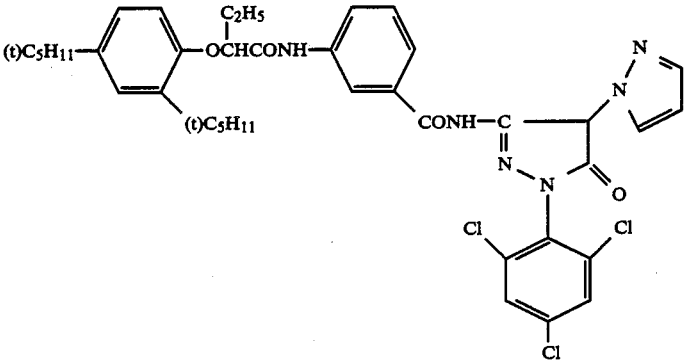
C-14
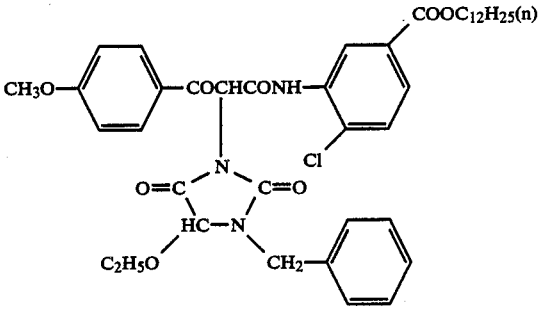
Cpd-A
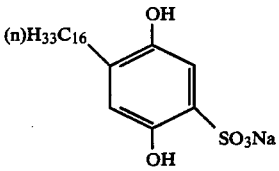
Cpd-B
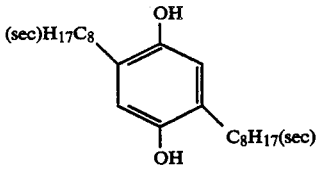
Compound 6
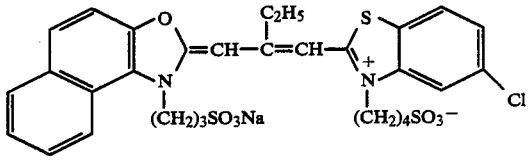
Compound 7
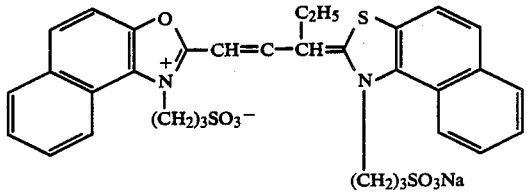

TABLE 16-continued

| Compounds used in Example 5 | |
|---|---|
| 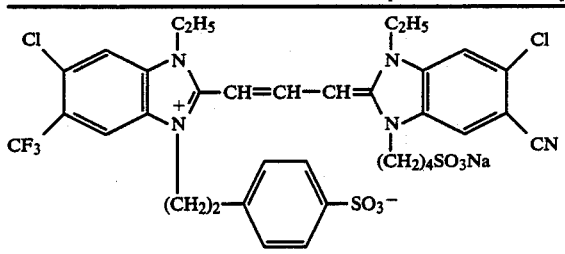 | Compound 8 |
| $CH_2{=}CH{-}SO_2{-}CH_2{-}CONH{-}CH_2$<br>$CH_2{=}CH{-}SO_2{-}CH_2{-}CONH{-}CH_2$ | H-1 |
| 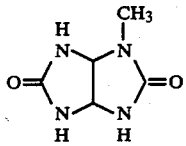 | S-1 |
| 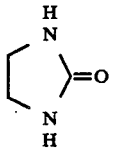 | S-2 |

What is claimed is:

1. A photographic light-sensitive material comprising a support having thereon at least one silver halide emulsion layer, wherein at least 70% of a total number of silver halide grains contained in said emulsion layer are regular crystal grains not having a twinning plane, at least 50 mol % of said regular grains are silver chloride, and said regular crystal grains have a (111) crystal plane on at least 30% of a total grain surface and are chemically sensitized in the presence of a gold compound or sulfur and gold compounds.

2. The material as in claim 1, wherein said regular crystal grains are spectrally sensitized by at least one blue spectral sensitizing dye.

3. A method of developing a photographic light-sensitive material which has been exposed to light, wherein the photographic light-sensitive material according to claim 1 is color-developed in the presence of a color coupler.

4. The method as in claim 3, wherein said color coupled is a non-diffusible and four-equivalent or two-equivalent coupler.

5. The material as in claim 1, wherein at least 75 mol % of said regular crystal grains comprises silver chloride.

6. The material as in claim 1, wherein at least 90 mol % of said regular crystal grains comprises silver chloride.

7. The material as in claim 1, wherein said regular crystal grains are chemically sensitized with a gold sensitizing agent of at least $5\times10^{-6}$ mol per mol of the silver halide.

8. The material according to claim 7, wherein the gold sensitizing agent of at least $1.5\times10^{-5}$ mol per mol of the silver halide is used.

9. The material as in claim 1, wherein said regular crystal grains are chemically sensitized in the presence of a sulfur sensitizing agent and a gold sensitizing agent of at least 250 mol % with respect to said sulfur sensitizing agent.

10. The material as in claim 1, wherein said regular crystal grains are spectrally sensitized with at least one of the sensitizing dyes represented by formulas (IIIa), (IIIb), and (IIIc);

Formula (IIIa)

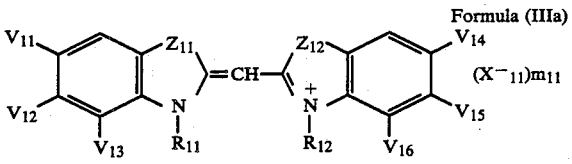

wherein, $Z_{11}$ represents oxygen, sulfur, or selenium, $Z_{12}$ represents sulfur or selenium;

$R_{11}$ and $R_{12}$ each represent alkyl having six carbon atoms or less, or alkenyl having six carbon atoms or less;

$V_{11}$ represents hydrogen, alkyl having four carbon atoms or less, or alkoxy having four carbon atoms or less, $V_{12}$ represents phenyl, alkyl having five carbon atoms or less, alkoxy having four carbon atoms or less, chlorine, hydrogen, substituted or unsubstituted phenyl, or hydroxyl, and $V_{13}$ represents hydrogen, and $V_{11}$, $V_{12}$, and $V_{13}$ also represents that $V_{11}$ and $V_{12}$, or $V_{12}$ and $V_{13}$ can be coupled to form a condensed benzene ring, $V_{14}$, $V_{15}$, and $V_{16}$ represent the same meanings as those represented by $V_{11}$, $V_{12}$, and $V_{13}$;

$X^-_{11}$ represents anion residue of acid; and $m_{11}$ represents 0 or 1;

Formula (IIIb)

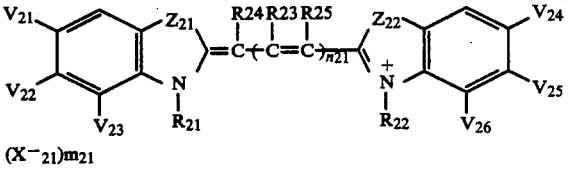

$(X^{-}_{21})_{m21}$ wherein $Z_{21}$ and $Z_{22}$ each represent oxygen, sulfur, selenium, or

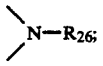

$R_{21}$ and $R_{22}$ represent the same meanings as those represented by $R_{11}$ and $R_{12}$ of formula (IIIa), and also represent that $R_{21}$ and $R_{24}$, or $R_{22}$ or $R_{25}$ can be coupled to form a 5- or 6-membered carbon ring, $R_{23}$ represents hydrogen, lower alkyl, or lower phenethyl, and also represents that different $R_{23}$ and $R_{23}$ can be coupled to form a 5- or 6-membered ring, $R_{24}$ and $R_{25}$ represent hydrogen, $R_{26}$ and $R_{27}$ represent the same meanings as that represented by $R_{21}$ and $R_{22}$;

$V_{21}$ represents hydrogen, alkyl having five carbon atoms or less, alkoxy having five carbon atoms or less, or chlorine, $V_{22}$ represents hydrogen, alkyl having five carbon atoms or less, alkoxy having five carbon atoms or less, chlorine, or substituted or unsubstituted phenyl, alkoxycarbonyl, having five carbon atoms or less, alkoxy having four carbon atoms or less, acylamino having four carbon atoms or less, chlorine, trifluoromethyl, cyano, or alkylsulfonyl having four carbon atoms or less, and also represents that $V_{22}$ can be coupled to $V_{21}$ or $V_{23}$ to form a condensed benzene ring, $V_{23}$ represents hydrogen, $V_{24}$ represents the same meaning as that represented by $V_{21}$, $V_{25}$ represents the same meaning as that represented by $V_{22}$, and also represents that $V_{25}$ can be coupled to $V_{24}$ or $V_{26}$ to form a condensed benzene ring, $V_{26}$ represents hydrogen;

$X^{-}_{21}$ represents anion residue of acid;

$m_{21}$ represents 0 or 1; and $n_{21}$ represents 1, 2, 3;

Formula (IIIc)

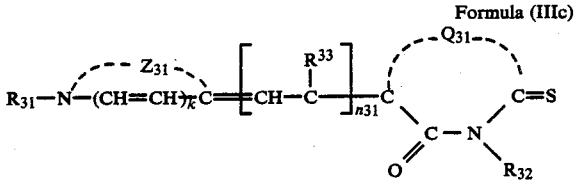

wherein, $Z_{31}$ represents an atom group required for forming substituted or unsubstituted nuclei or thiazoline, thiazole, benzothiazole, naphtholthiazole, selenazoline, selenazole, benzoselenazole, naphthoselenazole, benzimidazole, naphthoimidazole, oxazole, benzoxazole, naphthooxazole, or pyridine;

$R_{31}$ represents the same meaning as that represented by $R_{11}$ or $R_{12}$ of formula (IIIa), $R_{32}$ represents the same meaning as that represented by $R_{11}$ or $R_{12}$ or formula (IIIa), and also represents hydrogen, furfuryl, or monocyclic aryl, $R_{33}$ represents alkyl having five carbon atoms or less, phenethyl, phenyl, 2-carboxyphenyl, and also represents that different $R_{33}$ and $R_{33}$ can be coupled to form a 5- 6-membered ring;

$Q_{31}$ represents oxygen, sulfur, selenium, or

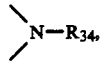

$R_{34}$ represents hydrogen, pyridil, phenyl, substituted phenyl or an aliphatic hydrocarbon group having eight carbon atoms or less which may contain oxygen, sulfur, or nitrogen in a carbon chain;

k represents 0 or 1; and $n_{31}$ represents 0, 1, 2, or 3.

11. The material as in claim 1, containing at least one compound having a mercapto group represented by formula (IV);

Formula (IV)

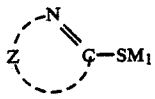

wherein , $M_1$ represents a protective group for mercapto, which is cleaved by hydrogen, cation, or alkali; and Z represents an atom group required for forming a 5-6-membered heterocyclic ring.

12. The material as in claim 1, wherein said photographic light-sensitive material is a color photographic light-sensitive material having at least one of couplers giving yellow, magenta, and cyan dyes, by color development.

13. The material as in claim 1, containing at least one yellow coupler, at least one magenta coupler, and at least one cyan coupler.

14. The material as in claim 1, having at least one blue-sensitive silver halide emulsion layer containing a yellow coupler, at least one green-sensitive silver halide emulsion layer containing a magenta coupler, and at least one red-sensitive silver halide emulsion layer containing a cyan coupler.

15. The material as in claim 12, wherein said support is transparent.

16. The material as in claim 1, wherein ISO sensitivity is at least 25.

17. The material as in claim 12, wherein a negative type dye image can be obtained.

18. The method as in claim 3, wherein color development is performed using p-phenylenediamine-type color developer.

19. The method as in claim 3, wherein color development is performed using N-hydroxylalkyl-substituted-p-phenylenediamine derivatives.

20. The method as in claim 3, wherein color development is performed using a color developer substantially not containing iodide ions.

21. The method as in claim 3, wherein color development is performed using a color developer substantially not containing sulfite.

22. The method as in claim 3, wherein color development is continuously performed using a color developer in which bromide ions are maintained at not more than $1.0\times10^{-2}$ mol/liter.

23. The method as in claim 3, wherein bleaching-fixing is performed after color development.

24. The method as in claim 3, wherein development is finished within 120 seconds.

* * * * *